United States Patent [19]

Ikeda et al.

[11] Patent Number: 4,956,269

[45] Date of Patent: Sep. 11, 1990

[54] SILVER HALIDE COLOR PHOTOGRAPHIC MATERIALS

[75] Inventors: Hideo Ikeda; Shigeru Ohno, both of Kanagawa, Japan

[73] Assignee: Fuji Photo Film Co., Ltd., Kanagawa, Japan

[21] Appl. No.: 441,592

[22] Filed: Nov. 27, 1989

[30] Foreign Application Priority Data

Nov. 24, 1988 [JP] Japan ..... 63-296778

[51] Int. Cl.[5] ..... G03C 1/46

[52] U.S. Cl. ..... 430/505; 430/507; 430/522; 430/521; 430/519; 430/359; 430/496

[58] Field of Search ..... 430/505, 507, 522, 521, 430/519, 359, 496

[56] References Cited

U.S. PATENT DOCUMENTS

| | | | |
|---|---|---|---|
| 2,538,009 | 1/1951 | Keyes et al. | 430/507 |
| 4,439,520 | 3/1984 | Kofron et al. | 430/496 |
| 4,564,590 | 1/1986 | Sasaki et al. | 430/505 |
| 4,618,570 | 10/1986 | Kadowaki et al. | 430/505 |
| 4,833,069 | 5/1989 | Hamada et al. | 430/505 |

*Primary Examiner*—Paul R. Michl
*Assistant Examiner*—Thomas R. Neville
*Attorney, Agent, or Firm*—Sughrue, Mion, Zinn, Macpeak & Seas

[57] ABSTRACT

A silver halide color photographic material comprising a support having thereon at least one red-sensitive silver halide emulsion layer, at least one green-sensitive silver halide emulsion layer and at least one blue-sensitive silver halide emulsion layer, wherein each of the green-sensitive silver halide emulsion layer, the red-sensitive silver halide emulsion layer and the blue-sensitive silver emulsion layer contains at least one color image forming coupler, and wherein 50% or more of the total projected area of the silver halide grains in at least one of the emulsion layers comprises tabular silver halide grains having a thickness of less than 0.5 μm, a diameter of 0.6 μm or more and an average aspect ratio of 3 or more and the red-sensitive emulsion layer and/or the green-sensitive emulsion layer contains a dye in an amount sufficient to reduce the sensitivity thereof by 20% or more based on the sensitivity of the red-sensitive emulsion layer and/or the green-sensitive emulsion layer containing no dye, the dry film thickness from the photosensitive emulsion layer that is farthest from the support to the photosensitive emulsion layer that is nearest the support is 16.0 μm or less and the swelling ratio of the silver halide color photographic material excluding the support is 1.25 or more.

10 Claims, 1 Drawing Sheet

FIGURE
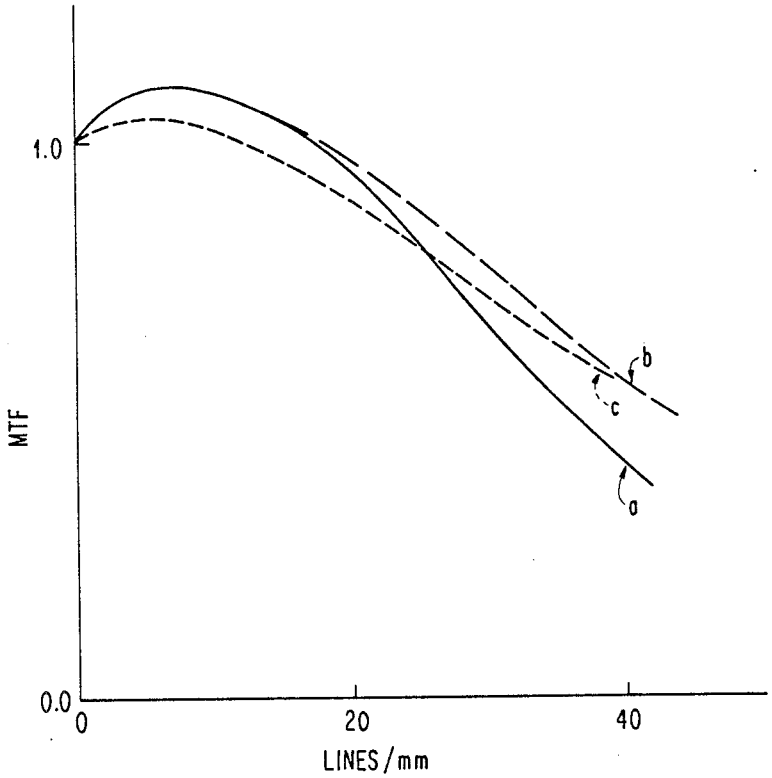

SILVER HALIDE COLOR PHOTOGRAPHIC MATERIALS

FIELD OF THE INVENTION

The present invention relates to a silver halide color photographic material having an improved image sharpness.

BACKGROUND OF THE INVENTION

It is generally known that, in multilayer color photographic materials having blue-sensitive, green-sensitive and red-sensitive silver halide emulsion layers, scattering of light by silver halide grains tends to reduce the sharpness of the lower emulsion layers.

Color photographic photosensitive materials in which sharpness, sensitivity and graininess are improved by use of a tabular silver halide emulsion are disclosed in U.S. Pat. Nos. 4,439,520 and 4,433,048. Sharpness is normally expressed as an MTF value, and the details thereof are described in James, *Theory of the Photographic Process,* 4th Edition, p. 596 and p. 104, Macmillan Publishing Co., Ltd. (1977). It is well known that, using the MTF representation, the sharpness of the photosensitive material displays a frequency dependency having a pattern such as that of curve (a) of the Figure, for example, and that the pattern is the result of optical scattering in the emulsion layers of the photosensitive material and of effects caused by development.

The improvement in sharpness using tabular grain emulsions does not always result in a significant improvement over the entirety of the MTF frequencies. However, what is frequently observed is that use of such emulsions results in an improvement which, in contrast to the pattern of curve (a) in the Figure, is restricted mainly to the high frequency region as illustrated by curve (b) in the Figure or in an improvement in the high frequency region together with a deterioration in the low frequency region as illustrated by curve (c) in the Figure.

In general, low-frequency MTF values of 20 lines/mm or less affect visually perceived sharpness more than high frequency MTF values and there is a particular demand for an improvement in this respect.

SUMMARY OF THE INVENTION

An object of the present invention is therefore to provide a silver halide color photographic material which has excellent sharpness.

Another object of the present invention is to provide a silver halide color photographic material wherein the tabular silver halide grains have a minimum thickness of 0.05 μm.

A further object of the present invention is to provide a silver halide color photographic material wherein the aspect ratio of the tabular silver halide grains is 50 or below.

A still another object of the present invention is to provide a silver halide color photographic material wherein the reduction of the red and/or green sensitivity of layers is up to 90%.

A still further object of the present invention is to provide a silver halide color photographic material wherein the film thickness is from about 5 to about 16 μm.

A yet further object of the present invention is to provide a silver halide color photographic material wherein the swelling ratio is 2.0 or less.

The object of the present invention can be achieved by a silver halide color photographic material comprising a support having provided thereon at least one red-sensitive silver halide emulsion layer, at least one green-sensitive silver halide emulsion layer and at least one blue-sensitive silver halide emulsion layer, wherein each of the green-sensitive silver halide emulsion layer, the red-sensitive silver halide emulsion layer and the blue-sensitive silver halide emulsion layer contains at least one color image forming coupler, and wherein 50% or more of the total projected area of the silver halide grains in at least one of the emulsion layers comprises tabular grains having a thickness of less than 0.5 μm, a diameter of 0.6 μm or more and an average aspect ratio of 3 or more, and the red-sensitive emulsion layer and/or the green-sensitive emulsion layer contains a dye in an amount sufficient to reduce its sensitivity by 20% or more based on the sensitivity of the red-sensitive emulsion layer and/or the green-sensitive emulsion layer containing no dye, the dry film thickness from the photosensitive emulsion layer that is farthest from the support to the photosensitive emulsion layer that is nearest the support is 16.0 μm or less and the swelling ratio of the silver halide color photographic material, excluding the support and any hydrophilic layers coated on the support on the opposite side of the photosensitive silver halide emulsion layer, is 1.25 or more.

BRIEF DESCRIPTION OF THE DRAWINGS

Figure is a plot of photographic material MTF values and has spatial frequency on the abscissa and MTF values on the ordinate.

DETAILED DESCRIPTION OF THE INVENTION

It is well known that the silver halides of emulsion layers are a major cause of light scattering. Generally with a so-called tabular grain emulsion in which grains have a high degree of flatness, irradiation of grains at an angle of incidence greater than a critical angle determined by the the difference between the refactive indices of the dispersion medium (which for practical purposes can be regarded as gelatin) and the silver halide emulsion results in reflection more frequently than it does in cases where thick grains or spherical grains are used. On the other hand, it is considered that fully reflected light will be subjected to further reflection by other tabular grains or at an interface between a dispersion medium other than the silver halide dispersion medium and a phase with a different refractive index (e.g., at the interface between a protective layer and air). Also, as a result of this repeated scattering, blurring of light becomes greater as the distance of travel of the light from the point of incidence on the emulsion film in the direction normal to the emulsion surface increases. Thus, the blurring can be reduced by reducing the thickness of the emulsion film.

Further, this blurring can be reduced and better low-scattering characteristics can be achieved by use of anti-irradiation dyes.

However, the low-frequency region MTF values achieved in this case still are not satisfactory and satisfactory low frequency region MTF values are only achieved by setting the film thickness and swelling ratio in the ranges described above.

The proportion of an emulsion layer composed of the tabular silver halide grains that are used in the present invention is preferably 50% or more of the total projected area, a proportion of 70% or more being more preferred and 90% or more being the most preferred.

In the present invention, the term "aspect ratio" is used herein for the tabular grain to signify the diameter/thickness ratio of the grain. The term "diameter" as used herein means the diameter of a circle with an area equal to the grain's projected area, and the term "thickness" as used herein means the distance between the two parallel surfaces that define the tabular silver halide grain.

The aspect ratio of the tabular grains used in this invention is 3 or more and, depending on practical requirements, it can be 3 to 8 or may be even more than 8, i.e., 50 or below, preferably 20 or below.

The diameter of the tabular silver halide grains used in the present invention is not less than 0.6 μm and not more than 5.0 μm and is preferably 0.8 to 3.0 μm. The thickness is less than 0.5 μm and is preferably 0.4 to 0.05 μm and still more preferably 0.3 to 0.05 μm.

Silver bromide, silver iodobromide, silver chlorobromide, silver chloroiodobromide, silver chloride and silver iodide are preferred as halogen compositions for the tabular grains used in this invention. Silver iodobromide, silver bromide and silver chloroiodobromide and mixtures of these halides are particularly preferred for use in high-sensitive photosensitive materials. In the case of silver iodobromide, the silver iodide content is normally not more than 40 mol% and is preferably not more than 20 mol% and most preferably is 1 to 15 mol%.

The tabular grains may be grains having a uniform halogen composition or may be grains comprising two or more phases having different halogen compositions.

For example, where silver iodobromide is used, tabular silver iodobromide grains with a lamellar structure consisting of a plurality of phases, each with a different iodide content, can be used. Preferred examples of halogen compositions of tabular silver halide grains and halogen distributions in the grains are described in, e.g., JP-A-58-113,927, JP-A-58113,928, JP-A-59-99,433, JP-A-59-119,344 and JP-A-59-119,350. (The term "JP-A" as used herein means an "unexamined published Japanese patent application.)

The tabular grains grains can be those which are defined by (111) planes, (100) planes or a mixture of (111) and (100) planes.

As regards the sites of latent image formation, the grains may be those where latent images are formed mainly on the grain surfaces or those where latent images are formed mainly in the inside of grains. Grains where latent images are formed both on the grain surfaces and in grain interiors can also be used.

The preparation of the tabular silver halide grains is described hereinafter.

A suitable combination of methods that are known in the art may be employed to prepare the tabular silver halide grains.

For example, the grains can be prepared by forming seed crystals in which tabular grains are present in an amount of 40% or more by weight in an atmosphere having a relatively low pBr value of 1.3 or less and, while maintaining about the same pBr, simultaneously adding a silver salt and a halide solution to cause the seeds to grow.

It is desirable to add the silver salt and the halide solution in such a manner that there is no formation of new crystal nuclei during this grain growth stage.

The size of the tabular silver halide grains can be adjusted by control of the temperature, selection of the types and amounts of solvents and control of various parameters such as the rates of addition of the silver salt and halogen compound used at the time of grain growth.

If required, the grain size, shape (diameter/thickness ratio, etc.), size distribution and growth rate can be controlled by use of silver halide solvents during the preparation of the tabular silver halide grains of the present invention.

For example, by increasing the amount of solvent used, it is possible to produce a grain size distribution that is a monodisperse distribution and speed up the growth rate. On the other hand, an increase in the amount of silver halide solvent used tends to be accompanied by an increase in grain thickness.

Ammonia, thioethers and thioureas can be employed as commonly-used silver halide solvents.

Such silver halide solvents are added in order to speed up grain growth in preparing the tabular silver halide grains of the present invention. A procedure which may preferably be employed is to increase the rates of addition, the amounts added and the concentrations of a silver salt solution (e.g., an $AgNO_3$ aqueous solution) and a halide solution (e.g., a KBr aqueous solution) added.

More specific details of the tabular silver halide grains that can be used in the present invention, silver halide emulsions in which they are included and methods for preparing them are described in, e.g., U.S. Pat. Nos. 4,434,226, 4,439,520, 4,414,310, 4,425,425, 4,399,215, 4,435,501, 4,386,156, 4,400,463, 4,414,306 and 4,425,426, European Pat. No. 84,637A2, JP-A-59-99433 and *Research Disclosure,* No. 22534 (January 1983).

The following monodisperse hexagonal tabular grains can be used in the present invention.

The emulsion is a silver halide emulsion comprising a dispersion medium and silver halide grains, and 70% or more of the total projected area of the silver halide grains is composed of tabular silver halide in a hexagonal shape with a longest side to shortest side ratio of not more than 2 and which have two parallel surfaces as outer faces. The emulsion has a monodispersion characteristic such that the coefficient of variation of the grain size distribution of the hexagonal tabular silver halide grains (where this coefficient is the value obtained by dividing the variation (standard deviation) of the grain sizes represented as the diameters of the projected areas of the grains converted to a circle by the average grain size) is 20% or less and the aspect ratio is 3.0 or more and the grain size is 0.2 μm or more.

The compositions of these hexagonal tabular grains may be silver bromide, silver iodobromide, silver chlorobromide or silver chloroiodobromide compositions. If they contain iodide, the amount of iodide is 0 to 30 mol%. They may be in the form of grains with a uniform crystal structure or or grains with internal portions and external portions having different halogen compositions or they may have a lamellar structure. Preferably, reduction sensitization silver nuclei are present in the grains.

The silver halide grains can be prepared via nucleation-Ostwald ripening and grain growth, and the details of such a process are described in Japanese Patent Application 61-299155.

Of the layers making up the emulsion film, the thickness of layers which contain tabular silver halide grains is 0.1 to 6.0 μm and is preferably 0.2 to 3.0 μm and most preferably 0.5 to 2.0 μm.

The coating amount of silver in the form of tabular silver halide grains is 0.1 to 12 g/m$^2$, and an amount of 0.3 to 8 g/m$^2$ is particularly preferred.

Tabular grains, such as those described in Japanese Patent Application 62-54640 which have dislocations deliberately introduced into grains, may be used in the tabular silver halide emulsion of the present invention.

The tabular silver halide grains used can also be grains where the dispersion characteristic of the silver halide grain diameters and/or thickness is that a monodisperse characteristic as disclosed in JP-B-47-11,386. (The term "JP B as used herein means an" examined Japanese patent publication.)

What is meant here by describing the tabular silver halide grains as monodisperse is that they constitute a dispersion system in which 95% of the grains come within ±60%, and preferably within ±40% or still more preferably ±25%, of the number average grain size. The term "number average grain size" as used herein is the number average diameter determined from the projected area diameters of the silver halide grains.

Emulsions other than the tabular silver halide emulsion that can be used in the present invention comprise emulsions of silver halides such as silver bromide, silver iodobromide, silver chlorobromide, silver chloroiodobromide, silver chloride and silver chloroiodide, with silver iodobromide being preferred for high-sensitive photosensitive materials. In the case of silver iodobromide, the silver iodide is normally 40 mol% or less and is preferably 20 mol% or less and most preferably 15 mol% or less.

The silver halide grains may be the so-called regular grains with cubic, octahedral, tetradecahedral or similar regular crystal shapes, grains with a spherical or similar irregular crystal form or grains in which there are crystal defects such as twin crystal planes or they have a complex form of these forms. In addition, a mixture of grains with a variety of crystal forms may be used.

The silver halide grains may be micrograins with a grain diameter of about 0.1 micron or less or may be large-size grains with a projected area diameter of up to about 10 microns. They may be a monodisperse emulsion with a narrow distribution or a polydisperse emulsion with a broad distribution. However, use of grains with a grain size of 0.35 μm or less is preferred to maintain high MTF values.

The crystal structure of the emulsion grains may be one that is uniform or may be one in which internal portions and external portions have different halogen compositions or it may be a lamellar structure. These types of emulsion grains are described in, e.g., GB Pat. No. 1,027,146 and U.S. Pat. Nos. 3,505,068and 4,444,877. Further, silver halides with different compositions may be bonded by epitaxial bonding or silver halides may be bonded to compounds other than silver halides, e.g., silver thiocyanate or lead oxide. These types of emulsion grains are disclosed in, e.g., U.S. Pat. Nos. 4,094,684, 4,142,684, 4,142,900 and 4,459,353, GB Pat. No. 2,038,792, U.S. Pat. Nos. 4,349,622, 4,395,478, 4,433,501, 4,463,087, 3,656,962 and 3,852,067 and JP-A-59-162540.

The emulsion may be a surface latent image type emulsion in which latent images are formed mainly on the surfaces, an internal latent image type emulsion in which latent images are formed inside the grains or a type where latent images are formed both on the surfaces and in the interiors.

Silver halide photographic emulsions which can be used in combination in the present invention can be prepared by known methods, e.g., by the methods disclosed in *Research Disclosure,* Vol. 176, No. 17643 (December 1978), pages 22 to 23 (Emulsion Preparation and Types) and ibid., Vol. 187, No. 18716 (November 1979), page 648.

The photographic emulsions used in the present invention can be prepared by methods as described in, e.g., P. Glafkides, *Chimie et Physique Photographique* (Paul Montel Co., 1967), G. F. Duffin, *Photographic Emulsion Chemistry* (Focal Press, 1966) and V. L. Zelikman et al., Making and Coating Photographic Emulsion (Focal Press, 1964). That is, the method employed may be an acidic, a neutral or an ammonia method, etc. and any mode of reacting soluble silver salts and soluble halogen salts may be employed, e.g., one may employ a singleside mixing method, a simultaneous mixing method or a combination of such methods. It is also possible to use a method where grains are formed in the presence of an excess of silver ions (the so-called reverse mixing method). One mode of a simultaneous mixing method that may be employed is the so-called controlled double jet method in which the pAg of the liquid phase in which the silver halide is formed is kept constant. This method makes it possible to produce a silver halide emulsion in which the crystal form is regular and the grain size is close to uniform.

Various types of silver halide solvents (e.g., ammonia, potassium thiocyanate or the thioethers and thione compounds disclosed in U.S. Pat. No. 3,271,157, JP-A-51-12360, JP-A-53-82408, JP-A-53-144319, JP-A-54-100717 and JP-A-54-155828) can be used, if required, in preparation of photographic emulsions that can be used in combination in the present invention.

Silver halide emulsions comprising regular grains that can be in combination in the present invention can be produced by controlling the pAg and pH during grain formation. Details of such a process are given in, e.g., *Photographic Science and Engineering,* Vol. 6, pages 159 to 165 (1962), *The Journal of Photographic Science,* Vol. 12, pages 242 to 251 (1964), U.S. Pat. No. 3,655,394 and GB Pat. No. 1,413,748.

Emulsions which comprises silver halide grains with an average grain diameter larger than about 0.05 microns and in which at least about 95% of the grains by weight are within ±40% of the average grain diameter are representative of monodisperse emulsions. Emulsions in which the average grain diameter is about 0.05 to 2 microns and at least about 95% by weight or 95% by number of the silver halide grains are within the range ±20% of the average grain diameter can be used in the invention. Methods of preparing such emulsions are disclosed in U.S. Pat. Nos. 3,574,628 and 3,655,394 and GB Patent 1,413,748. It is also possible to use emulsions such as those disclosed in, e.g., JP-A-48-8600, JP-A-51-39027, JP-A-51-83097, JP-A-53-137133, JP-A-54-48521, JP-A-54-99419, JP-A-58-37635 and JP-A-58-49933.

Salts of cadmium, zinc, lead or thallium and salts or complex salts of iridium, rhodium or iron, etc. may be introduced in the silver halide grain formation or physical ripening stage.

Soluble salts can be removed from the emulsion before and after physical ripening by procedures such as noodle washing, flocculation precipitation or ultrafiltration, etc.

The emulsion of the present invention is normally used after physical ripening, chemical ripening and spectral sensitization. Additives that can be used in these stages are described in *Research Disclosure*, No. 17643 (December 1978) and ibid., No. 18716 (November 1979) and the relevant places in this journal are listed in the table below.

The above-described two issues of *Research Disclosure* also describe known photographic additives that can be used in the present invention and the following table notes where these additives are described.

| Type of additive | RD17643 | RD18716 |
|---|---|---|
| 1. Chemical Sensitizers | p. 23 | p. 684 r.h. col. |
| 2. Speed Improvers | | " |
| 3. Spectral Sensitizers Strong Color Sensitizers | p. 23 to 24 | p. 684 r.h. col. to p. 649 r.h. col. |
| 4. Brightening Agents | p. 24 | |
| 5. Antifoggants and Stabilizers | p. 24 to 25 | p. 649 r.h. col. |
| 6. Stain Preventives | p. 25 r.h. col. | p. 650 l.h. to r.h. col. |
| 7. Color Image Stabilizers | p. 25 | |
| 8. Hardeners | p. 26 | p. 651 l.h. col. |
| 9. Binders | p. 26 | " |
| 10. Plasticizers, Lubricants | p. 27 | p. 650 r.h. col. |
| 11. Coating Assistants, Surfactants | p. 26 to 27 | " |
| 12. Antistatic Agents | p. 27 | " |

Dyes are used in emulsion layers or intermediate layers in the present invention in amounts sufficient to reduce the red and/or green sensitivity of the layers by at least 20% and preferably by 30% or more, i.e., up to 90%.

Examples of dyes which can be used for this purpose include the oxonol dyes with pyrazolone nuclei or barbituric acid nuclei disclosed in, e.g., GB Pat. Nos. 506,385, 1,177,429, 1,311,884, 1,338,799, 1,385,371, 1,467,214, 1,433,102 and 1,553,516, JP-A-48-85,130, JP-A-49-114,420, JP-A-52-117,123, JP-A-55-161,233, JP-A-59-111,640, JP-B-39-22,069, JP-B-43-13,168 and U.S. Pat. Nos. 3,247,127, 3,469,985 and 4,078,933, other oxonol dyes such as those disclosed in, e.g., U.S. Pat. Nos. 2,533,472 and 3,379,533 and GB Pat. No. 1,278,621, the azo dyes disclosed in, e.g., GB Pat. Nos. 575,691, 680,631, 599,623, 786,907, 907,125 and 1,045,609, U.S. Pat. No. 4,255,326 and JP-A-59-211,043, the azomethine dyes disclosed in, e.g., JP-A-50-100,116, JP-A-54-118,247 and GB Pat. Nos. 2,014,598 and 750,031, the anthraquinone dyes disclosed in U.S. Pat. No. 2,865,752, the arylidene dyes disclosed in U.S. Pat. Nos. 2,538,009, 2,688,541 and 2,538,008, GB Pat. Nos. 584,609 and 1,210,252, JP-A-50-40,625, JP-A-51-3,623, JP-A-51-10,927, JP-A-54-118,247, JP-B-48-3,286 and JP-B-59-37,303, the styryl dyes disclosed in, e.g., JP-B-28-3,082, JP-B-44-16,594 and JP-B-59-28,898, the triarylmethane dyes disclosed in, e.g., GB Pat. Nos. 446,583 and 1,335,422 and JP-A-59-228,250, the merocyanine dyes disclosed in, e.g., GB Pat. Nos. 1,075,653, 1,153,341, 1,284,730, 1,475,228 and 1,542,807 and the cyanine dyes disclosed in, e.g., U.S. Pat. Nos. 2,843,486 and 3,294,539.

Of these dyes, dyes which are particularly suitable for use in the present invention are those represented by the following formulas (I), (II), (III) and (IV).

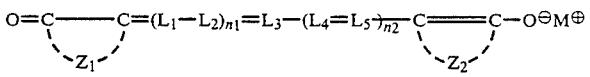

(I)

In Formula (I), $Z_1$ and $Z_2$, which may be the same or different, each represents the nonmetallic atoms necessary for forming a heterocyclic ring, $L_1$, $L_2$, $L_3$, $L_4$ and $L_5$, which may be the same or different, each represents a methine group, $n_1$ and $n_2$ each represents 0 or 1 and $M\oplus$ represents hydrogen or another univalent cation.

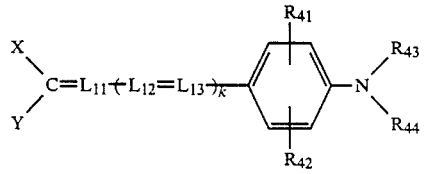

(II)

In Formula (II), X and Y, which may be the same or different, each represents an electron-attracting group, and X and Y may combine together to form a ring.

The electron-attracting groups represented by X and Y are those having a $\sigma$-value of the modified Hammett equation of 0.30 or more. Typical examples of the electron-attracting group include a cyano group; a carboxyl group; an alkylcarbonyl group having, preferably, not more than 7 carbon atoms., e.g., acetyl and propionyl, which may be substituted with, e.g., a halogen atom such as chlorine, etc.; and an arylcarbonyl group wherein the aryl moiety is preferably a phenyl group or a naphthyl group which may be substituted with a usual substituent.

Examples of the ring formed by X and Y include a pyrazolone ring, a pyrazolotriazole ring, an oxindol ring, an isoxazolone ring, a barbituric acid ring, a thiobarbituric acid ring, an indandione ring, and a pyridone ring, and, preferably, a pyrazolone ring.

$R_{41}$ and $R_{42}$, which may be the same or different, each represents a hydrogen atom, a halogen atom (e.g., chlorine or bromine), an alkyl group, preferably an alkyl group having 5 or less carbon atoms which may be substituted, an alkoxy group, preferably an alkoxy group having 5 or less carbon atoms which may be substituted, a hydroxyl group, a carboxyl group, a substituted amino group, a carbamoyl group, a sulfamoyl group, an alkoxycarbonyl group or a sulfo group.

$R_{43}$ and $R_{44}$, which may be the same or different, each represents a hydrogen atom or an alkyl, alkenyl, aryl, acyl having 2 to 20 carbon atoms or sulfonyl group and they may combine together to form a 5- to 6-membered ring. Also, a 5- to 6-membered heterocyclic ring may be formed by the combination of $R_{41}$ with $R_{43}$ or of $R_{42}$ with $R_{44}$.

$R_{43}$ and $R_{44}$ each preferably represents a hydrogen atom or an alkyl group having 8 or less carbon atoms which may be substituted with a usual substituent. The ring formed by $R_{43}$ and $R_{44}$ is a 5- or 6-membered heterocyclic ring containing at least one hetero atom of 0, N and S, e.g., a piperidine ring or a morpholine ring.

At least one of X, Y, $R_{41}$, $R_{42}$, $R_{43}$ and $R_{44}$ has a sulfo or carboxyl group as a substituent. The sulfo group and the carboxyl group may be a free form or a salt form, e.g., a sodium salt, a potassium salt, a $(C_2H_5)_3NH$ salt, a pyridinium salt or an ammonium salt.

$L_{11}$, $L_{12}$ and $L_{13}$ each represents a methine group which may be substituted with, for exadmple, methyl, ethyl, cyano, phenyl, chlorine or sulfoethyl. k represents 1 or 0.

$$Ar_1—N=N—Ar_2 \quad \text{(III)}$$

In Formula (III), $Ar_1$ and $Ar_2$, which may be the same or different, each represents an aryl group having 6 to 10 carbon atoms (e.g., 4-sulfophenyl, 2-sulfophenyl, 2,5-disulfophenyl, 2-hydroxy-4-sulfophenyl, 1,8-dihydroxy-3,6-disulfo-2-naphthyl, 2-hydroxy-4-sulfo-1-naphthyl), or a 5- or 6-membered nitrogen-containing heterocyclic group (e.g., 1-(4-sulfophenyl)-3-carboxy-5-hydroxy-4-pyrazolyl, 1-(4-sulfophenyl)-3-methyl-5-hydroxy4-pyrazolyl). methyl-5-hydroxy-4-pyrazolyl).

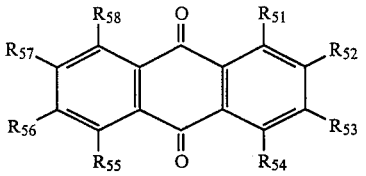

(IV)

In Formula (IV), $R_{51}$, $R_{54}$, $R_{55}$ and $R_{58}$, which may be the same or different, each represents a hydrogen atom, a hydroxy group, an alkoxy group having 1 to 6 carbon atoms such as methoxy, ethoxy or n-butoxy, an aryloxy group such as phenoxy, a carbamoyl group or an amino group

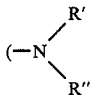

wherein R' and R'', which may be the same or different, each represents an alkyl group having 1 to 6 carbon atoms such as methyl, ethyl, propyl or butyl, or an aryl group having 6 to 10 carbon atoms such as phenyl or naphthyl, possessing at least one sulfonic acid or carboxyl group, or a hydrogen atom).

$R_{52}$, $R_{53}$, $R_{56}$ and $R_{57}$, which may be the same or different, each represents a hydrogen atom, a sulfonic acid group, a carboxyl group or an alkyl group having 1 to 6 carbon atoms such as methyl, ethyl, propyl or butyl, an aryl group having 6 to 10 carbon atoms such as phenyl or naphthyl, possessing at least one sulfonic acid or carboxyl group.

These various dyes are described in detail below.

In Formula (I), heterocyclic rings formed by the nonmetallic atoms represented by $Z_1$ and $Z_2$ are preferably nitrogen-containing 5- or 6-membered rings and they may be monocyclic or fused rings, for example, 5-pyrazolone, 6-hydroxypyridone, pyrazolo[3,4-b]pyridine-3,6-dione, barbituric acid, pyrazolidinethione, thiobarbituric acid, rhodanine, imidazopyridine, pyrazolopyrimidine, pyrrollidone and pyrazoloimidazole.

The methine groups represented by $L_1$, $L_2$, $L_3$, $L_4$ and $L_5$ may be substituted with substituent groups (e.g., methyl, ethyl, phenyl, chlorine atoms, sulfoethyl, carboxyethyl, dimethylamino, cyano) and the substituents may mutually combine to form a 5- or 6-membered ring (e.g., cyclohexene, cyclopentene, 5,5-dimethylcyclohexene).

Examples of univalent cations other than hydrogen that are represented by M⊕ include Na⊕, K⊕, $HN⊕(C_2H_5)_3$,

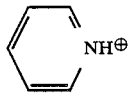

and Li⊕.

Particularly preferred dyes of the dyes represented by Formula (I) are the dyes represented by the following formulas (I-a), (I-b), (I-c), (I-d) and (I-e).

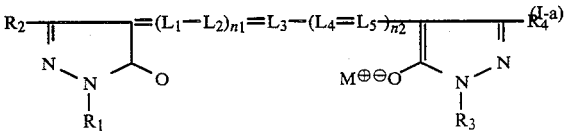

In Formula (I-a), $R_1$ and $R_3$, which may be the same or different, each represents an aliphatic group, an aromatic group or a heterocyclic group, $R_2$ and $R_4$, which may be the same or different, each represents an aliphatic group, an aromatic group, —$OR_5$-, —$COOR_5$, —$NR_5R_6$, —$CONR_5R_6$, —$NR_5CONR_5R_6$, —$SO_2R_7$, —$COR_7$, —$NR_6COR_7$, —$NR_6SO_2R_7$ or a cyano group (wherein $R_5$ and $R_6$, which may be the same or different, each represents a hydrogen atom, an aliphatic group or an aromatic group, $R_7$ represents an aliphatic group or an aromatic group, and a 5- or 6-membered ring may be formed by the combination of $R_5$ with $R_6$ or of $R_6$ with $R_7$) and $L_1$, $L_2$, $L_3$, $L_4$, $L_5$, $n_1$, $n_2$ and M⊕ have the same meanings as in Formula (I).

The aliphatic group represented by $R_1$, $R_2$, $R_3$, $R_4$, $R_5$, $R_6$ or $R_7$ may be a straight-chain, branched-chain or cyclic alkyl group having 1 to 20 carbon atoms or an aralkyl group having 7 to 20 carbon atoms. The aromatic group represented by $R_1$, $R_2$, $R_3$, $R_4$, $R_5$, $R_6$ or $R_7$ is preferably an aryl group having 6 to 20 carbon atoms. The heterocyclic group represented by $R_1$ or $R_3$ can be a 5- or 6-membered nitrogen-containing heterocyclic group including condensed rings, for example, 5-sulfopyridin-2-yl, 5-sulfobenzothiazol-2-yl, etc. The 5- or 6-membered ring formed by the combination of $R_5$ with $R_6$ or of $R_6$ with $R_7$ includes, for example, a pyrrolidine ring, a piperidine ring, a pyrrolidone ring, and a morpholine ring.

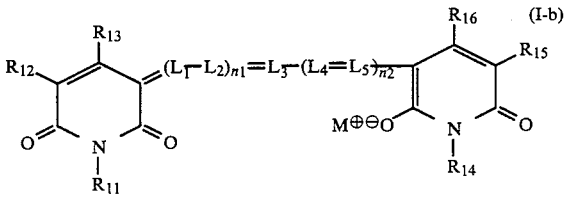

In Formula (I-b), $R_{11}$ and $R_{14}$, which may be the same or different, each represents a hydrogen atom, an aliphatic group, an aromatic group or a heterocyclic group, $—NR_{17}R_{18}$, $—NR_{17}CONR_{17}R_{18}$, $—NR_{18}COR_{19}$ or $—NR_{18}SO_2R_{19}$, $R_{12}$ and $R_{15}$ each represents a hydrogen atom or an aliphatic group, an aromatic group, a heterocyclic group, a cyano group or a sulfonic acid group, $—NR_{17}R_{18}$, $—NR_{18}COR_{19}$, $—NR_{18}SO_2R_{19}$, $—NR_{17}CONR_{17}R_{18}$, $—COOR_{17}$, $—CONR_{17}R_{18}$, $—COR_{19}$, $—SO_2R_{19}$ or $—SO_2NR_{17}R_{18}$, and $R_{13}$ and $R_{16}$, which may be the same or different, each represents a hydrogen atom, an aliphatic group, an aromatic group or a heterocyclic group, $—OR_{17}$, $—COOR_{17}$, $—COR_{19}$, $—CONR_{17}R_{18}$, $—NR_{17}R_{18}$, $—NR_{18}COR_{19}$, or $—NR_{18}SO_2R_{19}$, or $—NR_{17}CONR_{17}R_{18}$, $—SO_2R_{19}$, $—SO_2NR_{17}R_{18}$, $—OR_7$ or a cyano group (wherein $R_{17}$ and $R_{18}$, which may be the same or different, each represents a hydrogen atom, an aliphatic group or an aromatic group, $R_{19}$ represents an aliphatic group or an aromatic group, and a 5 or 6 membered ring may be formed by the combination of $R_{17}$ with $R_{18}$ or of $R_{18}$ with $R_{19}$). $L_1$, $L_2$, $L_3$, $L_4$, $L_5$, $N_1$, $n_2$ and $M\oplus$ have the same meanings as in Formula (I).

The aliphatic group represented by $R_{11}$, $R_{12}$, $R_{13}$, $R_{14}$, $R_{15}$, $R_{16}$, $R_{17}$, $R_{18}$ or $R_{19}$ may be a straight-chain, branched-chain or cyclic alkyl group having 1 to 20 carbon atoms or an aralkyl group having 7 to 20 carbon atoms. The aromatic group represented by $R_{11}$, $R_{12}$, $R_{13}$, $R_{14}$, $R_{15}$, $R_{16}$, $R_{17}$, $R_{18}$ or $R_{19}$ is preferably an aryl group having 6 to 20 carbon atoms. The heterocyclic group represented by $R_{11}$, $R_{12}$, $R_{13}$, $R_{14}$, $R_{15}$ or $R_{16}$ can be a 5- or 6-membered nitrogen-containing heterocyclic group, for example, 2-pyridyl, morpholino 5-sulfobenzimidazol-2-yl etc The 5- or 6-membered fring formed by the combination of $R_{17}$ with $R_{18}$ or of $R_{18}$ with $R_{19}$ includes, for example, a piperidine ring, a pyrrolidine ring, a morpholine ring, and a pyrrolidine ring.

and $L_5$ represents a group containing at least one carboxylic acid group or sulfonic acid group.

The aliphatic group represented by $R_{21}$, $R_{22}$, $R_{23}$, $R_{24}$, $R_{25}$, $R_{26}$, $R_{27}$, $R_{28}$ or $R_{29}$ may be a straight-chain, branched-chain or cyclic alkyl group having 1 to 20 carbon atoms or an aralkyl group having 7 to 20 carbon atoms. The aromatic group represented by $R_{21}$, $R_{22}$, $R_{23}$, $R_{24}$, $R_{25}R_{26}$, $R_{27}$, $R_{28}$ or $R_{29}$ is preferably an aryl group having 6 to 20 carbon atoms. The heterocyclic group represented by $R_{21}$, $R_{22}$, $R_{24}$ or $R_{25}$ can be a 5- or 6-membered nitrogen-containing heterocyclic group including condensed rings, for example, 5-sulfopyridin-2-yl, 5-sulfobenzothiazol -2-yl, etc. When $Z_{21}$ represents $NR_{30}$ and $Z_{22}$ represents $NR_{31}$, the 5-membered ring formed by the combination of $R_{30}$ with $R_{21}$ or of $R_{31}$ with $R_{24}$ includes, for example, an imidazole ring, a benzimidazole ring, and a triazole ring.

(I-d)

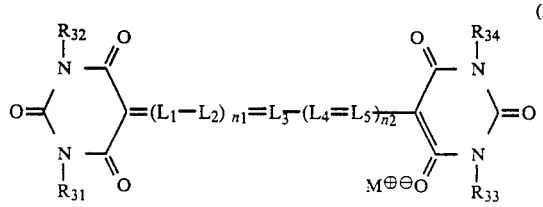

In Formula (I-d, $R_{31}$, $R_{32}$, $R_{33}$ and $R_{34}$, which may be the same or different, each represents a hydrogen atom, an aliphatic group, an aromatic group or a heterocyclic group and $L_1$, $L_2$, $L_3$, $L_4$, $L_5$, $n_1$, $n_2$ and $M\oplus$ have the same meanings as in formula (I). The aliphatic group, the aromatic group and heterocyclic group are the same as defined above for those of $R_1$ to $R_4$ in Formula (I-a).

(I-c)

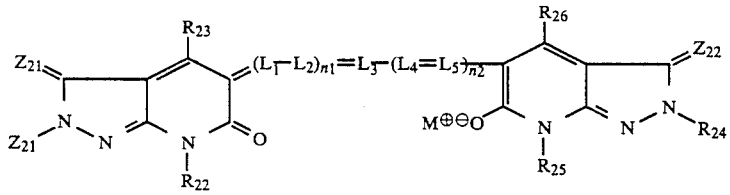

In Formula (Ic), $R_{21}$ and $R_{24}$, which may be the same or different, each represents an aliphatic group, an aromatic group or a heterocyclic group, $R_{22}$ and $R_{25}$, which may be the same or different, each represents a hydrogen atom, an aliphatic group, an aromatic group or a heterocyclic group, $—COR_{29}$ or $—SO_2R_{29}$, $R_{23}$ and $R_{26}$, which may be the same or different, each represents a hydrogen atom, a cyano group, an alkyl group or an aryl group, $—COOR_{27}$, $—OR_{27}$, $—NR_{27}R_{28}$, $—N(R_{28})COR_{29}$, $—N(R_{28})SO_2R_{29}$, $—CONR_{27}R_{28}$ or $—N(R_{27})CONR_{27}R_{28}$ (wherein $R_{29}$ represents an aliphatic group or an aromatic group and $R_{27}$ and $R_{28}$, which may be the same or different, each represents a hydrogen atom, an aliphatic group or an aromatic group), $Z_{21}$ represents an oxygen atom or $NR_{30}$, $_{22}$ represents an oxygen atom or $NR_{31}$ (wherein $R_{30}$ and $R_{31}$, which may be the same or different, each represents a nonmetallic atom group necessary for forming a 5 membered ring through combination with $R_{21}$ and $R_{24}$, respectively) and $L_1$, $L_2$, $L_3$, $L_4$, $L_5$, $n_1$, $n_2$ and $M\oplus$ have the same meanings as in formula (I). However, at least one of $R_{21}$, $R_{22}$, $R_{23}$, $R_{24}$, $R_{25}$, $R_{26}$, $L_1$, $L_2$, $L_3$, $L_4$ (I-e)

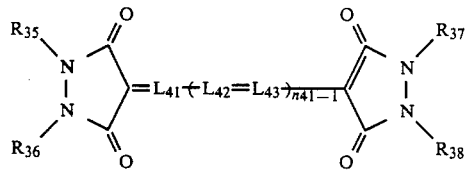

In Formula (I-e), $R_{35}$, $R_{36}$, $R_{37}$ and $R_{38}$, which may be the same or different, each represents an aliphatic group, for example, an alkyl group having 1 to 20 carbon atoms, an aromatic group, for example, an aryl group having 6 to 20 to carbon atoms, or a heterocyclic group, for example, 2-pyridyl or 2-imidazolyl; $L_{41}$, $L_{42}$ and $L_{43}$, which may be the same or different, each represents a methine group which may be substituted independently with methyl, ethyl, phenyl, chlorine, sulfoethyl, carboxyethyl, etc. $n_{41}$ represents 1, 2 or 3. One or more of $R_{35}$, $R_{36}$, $R_{37}$ and $R_{38}$ possesse a carboxyl group or a sulfo group, the total of the carboxyl and sulfo groups being two or more. Also, these carboxyl and sulfo groups can be a free form or a salt form such as a sodium salt, a potassium salt, or an ammonium salt.

Unless otherwise indicated for the dyes of Formulae (I), (II), (III) and (IV) including (I-a) to (I-e), the alkyl group has 1 to 20 carbon atoms, the aryl group has 6 to 20 carbon atoms, the heterocyclic group is a 3- to 8-membered ring containing at least one of N, O and S as hetero atoms, and the acyl group has 2 to 20 carbon atoms.

Examples of dyes represented by Formula (I-a) are shown below, although the invention is not to be construed as being limited to these examples.

| No. | $R_1$, $R_3$ | $R_2$, $R_4$ | $=(L_1-L_2)_{n_1}=L_3-(L_4=L_5)_{n_2}-$ | $M^{\oplus}$ |
|---|---|---|---|---|
| a-1 | 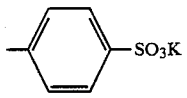 | $-CH_3$ | $=CH-$ | H |
| a-2 | 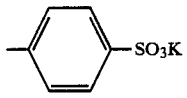 | $-CONHC_3H_7^{(n)}$ | $=CH-$ | H |
| a-3 | 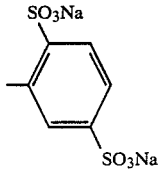 | $-OH$ | $=CH-CH=CH-$ | Na |
| a-4 | 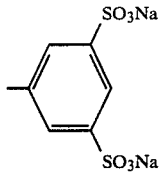 | $-OC_2H_5$ | $=CH-(CH=CH)_2-$ | Na |
| a-5 | $-CH_2CH_2SO_3K$ | $-COOC_2H_5$ | $=CH-CH=CH-$ | H |
| a-6 | 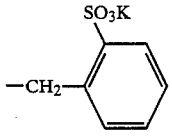 | $-CONHC_4H_9^{(n)}$ | $=CH-CH=CH-$ | H |
| a-7 | $-CH_2CH_2SO_3K$ | $-COOK$ | $=CH-(CH=CH)_2-$ | H |
| a-8 | 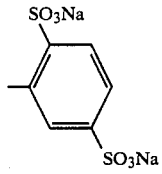 | $-COCH_3$ | $=CH-(CH=CH)_2-$ | Na |
| a-9 | 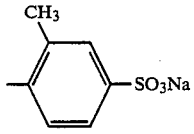 | $-CF_3$ | $=CH-(CH=CH)_2-$ | H |
| a-10 | 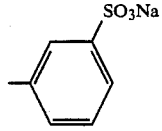 | $-NHCOCH_3$ | $=CH-CH=CH-$ | H |
| a-11 | 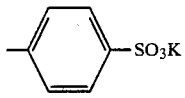 | $-COOC_2H_5$ | $=CH-(CH=CH)_2-$ | H |

-continued

| No. | $R_1$, $R_3$ | $R_2$, $R_4$ | $=(L_1-L_2)n_1=L_3-(L_4=L_5)n_2-$ | $M^{\oplus}$ |
|---|---|---|---|---|
| a-12 | 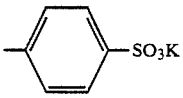 | $-COOK$ | $=CH-CH=CH-$ | H |
| a-13 | 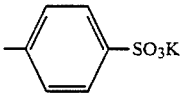 | $-NHCONHCH_3$ | $=CH-CH=CH-$ | H |
| a-14 | $-(CH_2)_4SO_3K$ | $-OH$ | $=CH-$ | H |
| a-15 | 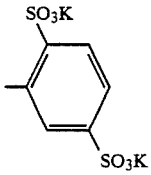 | $-COOK$ | $=CH-CH=CH-$ | K |
| a-16 | 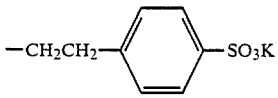 | $-C_6H_5$ | $=CH-CH=CH-$ | H |
| a-17 | 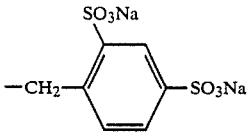 | $-COOC_2H_5$ | $=CH-(CH=CH)_2-$ | Na |
| a-18 | 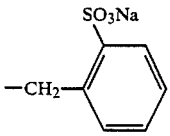 | $-CONHCH_2CH_2OH$ | $=CH-(CH=CH)_2-$ | H |
| a-19 | 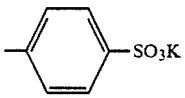 | $-CONHCH_2CH_2SO_3K$ | $=CH-(CH=CH)_2-$ | H |
| a-20 | $-(CH_2)_3SO_3K$ | $-CONHC_7H_{15}^{(n)}$ | $=CH-CH=CH-$ | H |
| a-21 | $-CH_2COOK$ | $-COOK$ | $=CH-CH=CH-$ | K |
| a-22 | $-CH_2CH_2SO_3K$ | $-N(CH_3)_2$ | $=CH-(CH=CH)_2-$ | H |
| a-23 | $-(CH_2)_3SO_3K$ | $-CN$ | $=CH-(CH=CH)_2-$ | H |
| a-24 | 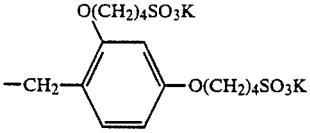 | $-CH_2Cl$ | $=CH-(CH=CH)_2-$ | H |
| a-25 | $-(CH_2)_2SO_3Na$ | $-OH$ | $=CH-(CH=CH)_2-$ | H |
| a-26 | 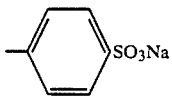 | $-CH_3$ | $=CH-\overset{CH_3}{\overset{\vert}{C}}=CH-$ | Na |
| a-27 | 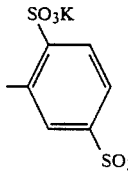 | $-SO_2CH_3$ | $=CH-(CH=CH)_2-$ | K |

-continued
| No. | $R_1$, $R_3$ | $R_2$, $R_4$ | $=(L_1-L_2)_{n_1}=L_3-(L_4=L_5)_{n_2}-$ | $M^{\oplus}$ |
|---|---|---|---|---|
| a-28 | 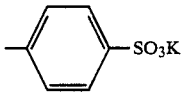 | $-CONHC_2H_5$ | $=CH-CH=CH-$ | H |
| a-29 | 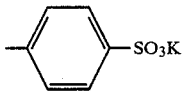 | $-NHCOC_3H_7^{(i)}$ | $=CH-CH=CH-$ | H |
| a-30 | $-CH_2CH_2SO_3K$ | 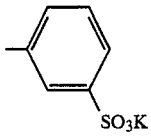 | $=CH-CH=CH-$ | H |
| a-31 | 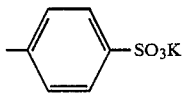 | $-CH_3$ | $=C(CH_3)-CH=CH-$ | H |
| a-32 | 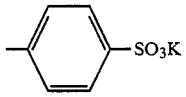 | $-{}^tC_4H_9$ | $=CH-CH=CH-$ | H |
| a-33 | 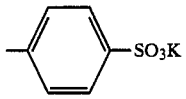 | $-CN$ | $=CH-CH=CH-CH=CH-$ | H |
| a-34 | 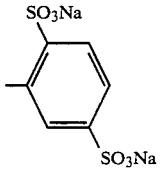 | $-COCH_3$ | $=CH-CH=C(CH_3)-CH=CH-$ | Na |
| a-35 | 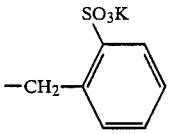 | $-COOK$ | $=CH-(CH=CH)_2-$ | H |
| a-36 | 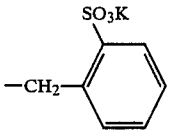 | $-COOK$ | $=CH-CH=CH-$ | H |
| a-37 | 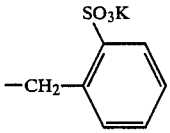 | $-CONHC_4H_9^{(i)}$ | $=CH-(CH=CH)_2-$ | H |
| a-38 | 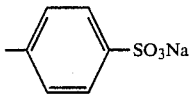 | $-NHSO_2CH_3$ | $=CH-(CH=CH)_2-$ | H |

-continued
| No. | $R_1$, $R_3$ | $R_2$, $R_4$ | $=(L_1-L_2)n_1=L_3-(L_4=L_5)n_2-$ | $M^{\oplus}$ |
|---|---|---|---|---|
| a-39 | 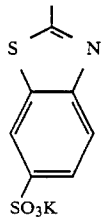 | $-CN$ | $=CH-(CH=CH)_2-$ | H |
| a-40 | 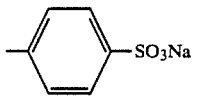 | $-OC_2H_5$ | $=CH-(CH=CH)_2-$ | H |
These dyes can be synthesized by the methods disclosed in GB Pat. Nos. 506,385, 1,177,429, 1,338,799, 1,385,371, 1,467,214, 1,433,102 and 1,553,516, JP-A-48-85130, JP-A-55-161233, JP-A-52-20330, JP-A-59-11640 and JP-A-62-273527.
Specific examples of dyes represented by Formula (I-b) are given below, although the invention is not to be construed as being limited to these examples.
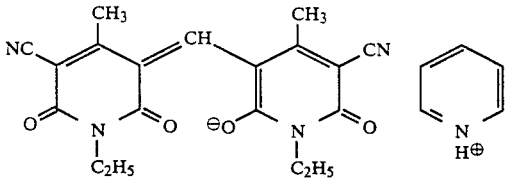
(b-1)
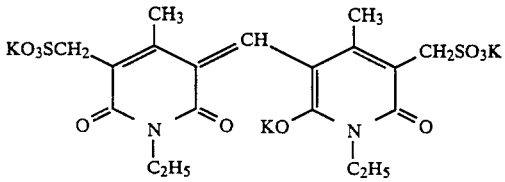
(b-2)
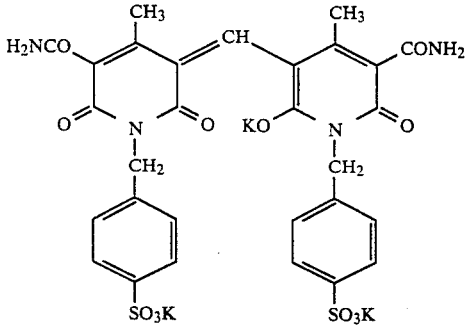
(b-3)
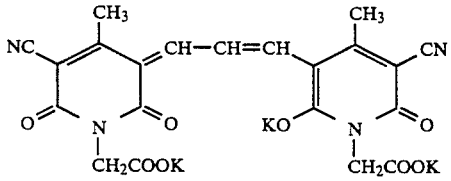
(b-4)
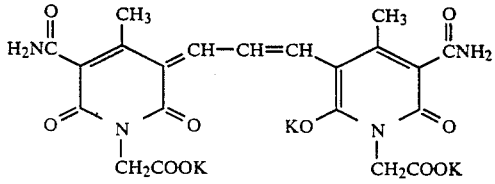
(b-5)

-continued
(b-6)
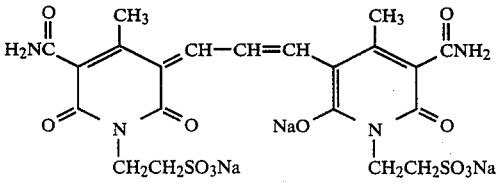
(b-7)
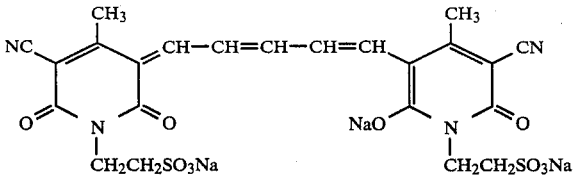
(b-8)
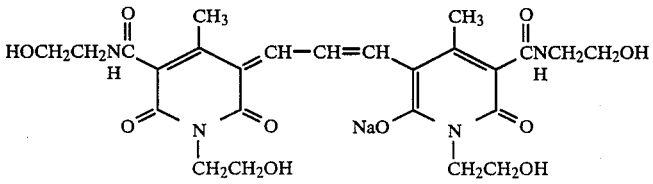
(b-9)
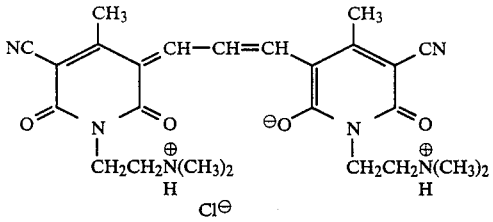
(b-10)
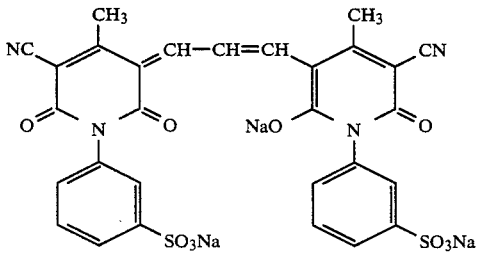
(b-11)
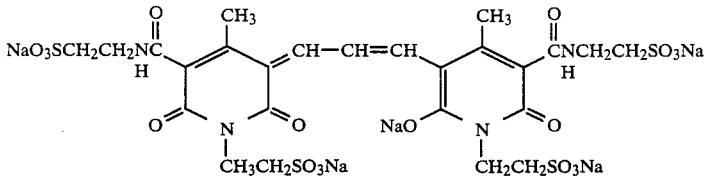
(b-12)
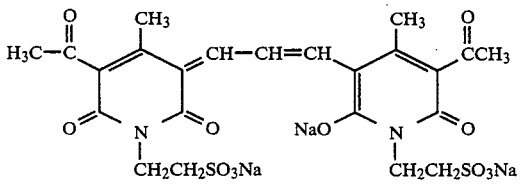
(b-13)
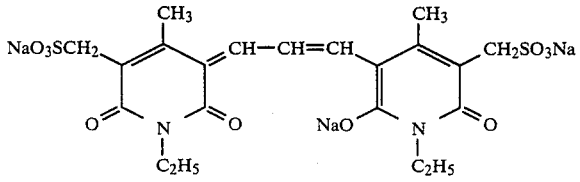

-continued
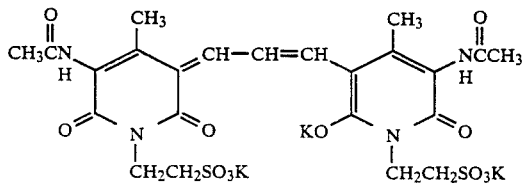
(b-14)
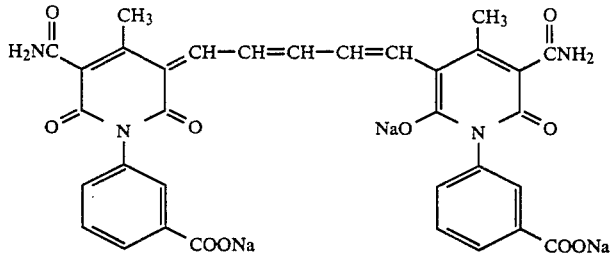
(b-15)
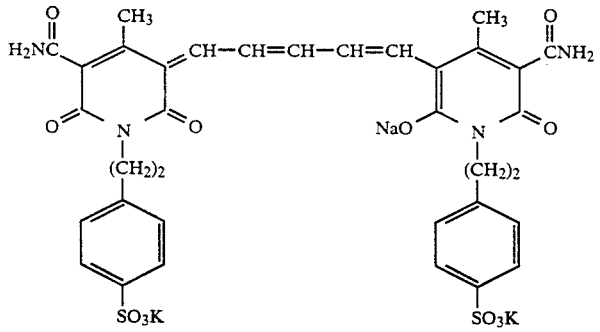
(b-16)
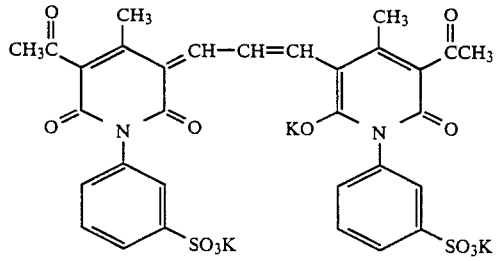
(b-17)
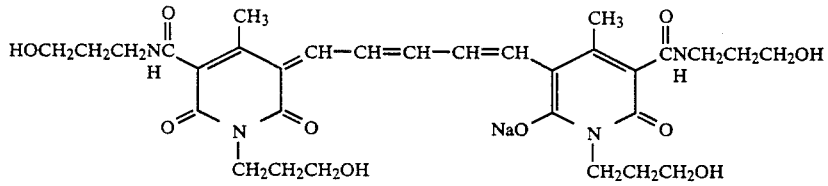
(b-18)
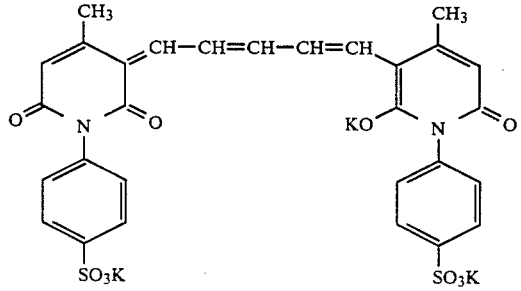
(b-19)

-continued (b-20)

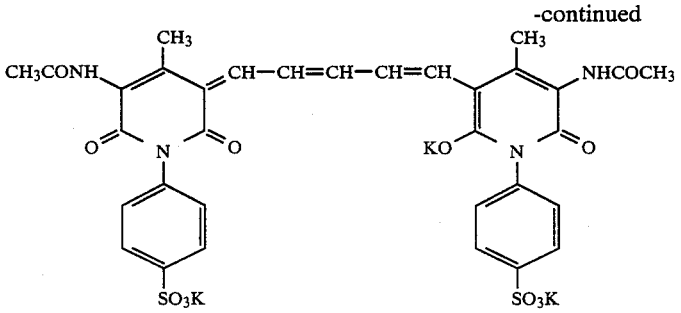

Dyes represented by general Formula (I-b can be synthesized by the methods disclosed in GB Pat. Nos. 1,278,621, 1,512,863 and 1,579,899.

Specific examples of dyes represented by Formula (I-c) are given below, although the invention is not to be construed as being limited to these examples.

| Compound | $R_{21}$, $R_{24}$ | $R_{22}$, $R_{25}$ | $R_{23}$, $R_{26}$ | $\neq L_1-L_2\rangle_{n_1}L_3(L_4=L_5\rangle_{n_2}$ | $Z_{21}$, $Z_{22}$ | $M^{\oplus}$ |
|---|---|---|---|---|---|---|
| C-1 | 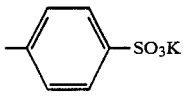 | $-CH_3$ | $-CH_3$ | $=CH-$ | O | H |
| C-2 | 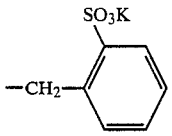 | 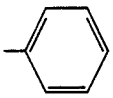 | $-COOK$ | $=CH-$ | O | K |
| C-3 | 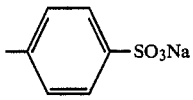 | $-H$ | $-OC_2H_5$ | $=CH-$ | O | H |
| C-4 | $\neq CH_2)_3SO_3H$ | $-CH_2CH_2OH$ | 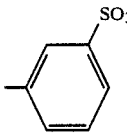 | $=CH-CH=CH-$ | O | H |
| C-5 | $\neq CH_2)_2SO_3K$ | $-COCH_3$ | $-COOK$ | $=CH-CH=CH-$ | O | H |
| C-6 | 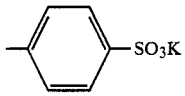 | $-CH_3$ | $-COOC_2H_5$ | $=CH-$ | O | K |
| C-7 | 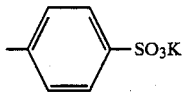 | $-CH_3$ | $-CH_3$ | $=CH-CH=CH-$ | O | H |
| C-8 | 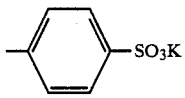 | $-H$ | $-COOK$ | $=CH-CH=CH-$ | O | H |
| C-9 | 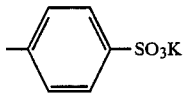 | $-CH_3$ | $-CH_3$ | $=CH\neq CH=CH\rangle_2$ | O | H |
| C-10 | $-CH_2CH_2COOH$ | $-CH_2CH_2OH$ | $-COOH$ | $=CH-CH=CH-$ | O | H |
| C-11 | $-CH_2CH_2SO_3K$ | 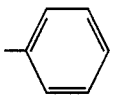 | $-CH_3$ | $=CH-CH=CH-$ | O | H |

-continued

| Compound | $R_{21}$, $R_{24}$ | $R_{22}$, $R_{25}$ | $R_{23}$, $R_{26}$ | $\neq L_1-L_2)_{n1}L_3(L_4=L_5)_{n2}$ | $Z_{21}$, $Z_{22}$ | $M^{\oplus}$ |
|---|---|---|---|---|---|---|
| C-12 | 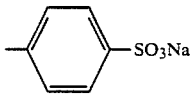 | 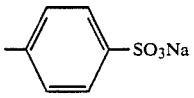 | $-CH_3$ | $=CH-CH=CH-$ | O | H |
| C-13 | 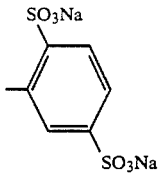 | $-CH_3$ | $-COONa$ | $=CH-CH=CH-$ | O | Na |
| C-14 | 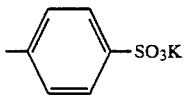 | $-CH_3$ | $-COOK$ | $=CH-CH=CH-$ | O | K |
| C-15 | 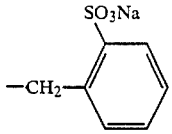 | $-(CH_2)_2SO_3Na$ | $-COONa$ | $=CH-CH=CH-$ | O | H |
| C-16 | $-CH_2CH_2SO_3K$ | $-COCH_3$ | $-COOK$ | $=CH-CH=CH-$ | O | H |
| C-17 | 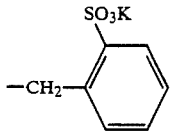 | 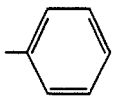 | $-CH_3$ | $=CH-CH=CH-$ | O | K |
| C-18 | 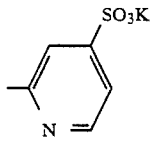 | $-H$ | $-CH_3$ | $=CH-CH=CH-$ | O | H |
| C-19 | 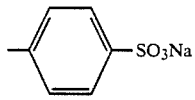 | $-CH_2CH_2OH$ | $-COONa$ | $=CH-CH=CH-$ | O | Na |
| C-20 | 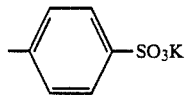 | $-CH_3$ | $-CONHCH_2CH_2OH$ | $=CH-CH=CH-$ | O | K |
| C-21 | $-(CH_2)_3SO_3K$ | $-CH_2CH_2COOK$ | 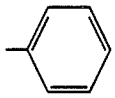 | $=CH-CH=CH-$ | O | H |
| C-22 | 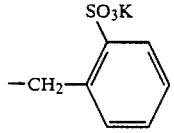 | $-CH_3$ | $-COOK$ | $=CH-CH=CH-$ | O | K |
| C-23 | $-CH_2CH_2SO_3K$ | $-CH_3$ | $-COOK$ | $=CH-CH=CH-$ | O | H |

-continued

| Compound | $R_{21}$, $R_{24}$ | $R_{22}$, $R_{25}$ | $R_{23}$, $R_{26}$ | $=(L_1-L_2)_{n1}L_3(L_4=L_5)_{n2}$ | $Z_{21}$, $Z_{22}$ | $M^{\oplus}$ |
|---|---|---|---|---|---|---|
| C-24 | 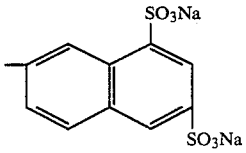 | $-CH_3$ | $-COONa$ | $=CH-CH=CH-$ | O | H |
| C-25 | 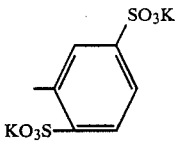 | $-CH_2CH_2OH$ | $-CH_3$ | $=CH-CH=CH-$ | O | H |
| C-26 | 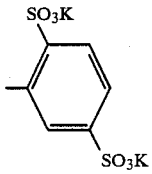 | $-CH_3$ | $-CH_3$ | $=CH-(CH=CH)_2-$ | O | K |
| C-27 | 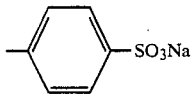 | $-CH_3$ | $-CN$ | $=CH-CH=CH-$ | O | Na |
| C-28 | 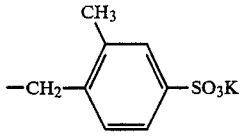 | 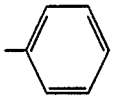 | $-CF_3$ | $=CH-CH=CH-$ | O | K |
| C-29 | 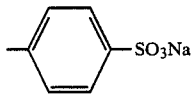 | $-(CH_2)_4SO_3Na$ | $-CH_3$ | $=CH-CH=CH-$ | O | Na |
| C-30 | 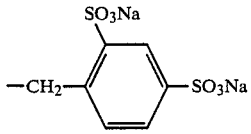 | $-CH_3$ | $-{}^tC_4H_9$ | $=CH-CH=CH-$ | O | Na |

The dyes represented by Formula (I-c) can be prepared using the methods disclosed in, e.g., JP-B-39-22069, JP-B-43-3504, JP-B-52-38056, JP-B-54-38129, JP-B-55-10059, JP-A-49-99620, JP-A-59-16834 and U.S. Pat. No. 4,181,225.

Specific examples of dyes represented by Formula (I-d) are given below, although the invention is not to be construed as being limited to these examples.

| No. | $R_{31}$, $R_{33}$ | $R_{32}$, $R_{34}$ | $=(L_1-L_2)_{n1}=L_3-(L_4=L_5)_{n2}$ | $M^{\oplus}$ |
|---|---|---|---|---|
| d-1 | $-{}^nC_4H_9$ | $-CH_2COOK$ | $=CH-$ | K |
| d-2 | $-CH_2CH_2OH$ | $-{}^nC_4H_9$ | $=CH-CH=CH-$ | H |
| d-3 | $-CH_2CH_2SO_3K$ | $-C_2H_5$ | $=CH-CH=CH-$ | H |
| d-4 | $-CH_2CH_2COOK$ | $-CH_2CH_2COOK$ | $=CH-CH=CH-$ | H |
| d-5 | $-CH_3$ | $-CH_3$ | $=CH-(CH=CH)_2-$ | H |
| d-6 | $-{}^nC_4H_9$ | $-CH_2COOK$ | $=CH-(CH=CH)_2-$ | H |
| d-7 | $-C_6H_5$ | $-CH_2COOK$ | $=CH-(CH=CH)_2-$ | H |
| d-8 | $-CH_2CH_2SO_3K$ | $-CH_2COOK$ | $=CH-$ | H |
| d-9 | 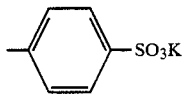 | H | $=CH-CH=CH-$ | H |
| d-10 | $-(CH_2)_3SO_3Na$ | H | $=CH-CH=CH-$ | H |
| d-11 | $-C_6H_5$ | $-(CH_2)_2SO_3K$ | $=CH-$ | H |
| d-12 | $-C_6H_5$ | $-(CH_2)_2SO_3K$ | $=CH-CH=CH-$ | H |

-continued

| No. | $R_{31}$, $R_{33}$ | $R_{32}$, $R_{34}$ | $=(L_1-L_2)_{n1}=L_3-(L_4=L_5)_{n2}$ | $M^{\oplus}$ |
|---|---|---|---|---|
| d-13 | $-C_6H_5$ | $-(CH_2)_2SO_3K$ | $=CH-(CH=CH)_2-$ | H |
| d-14 | $-CH_2COOC_2H_5$ | $-{}^nC_4H_9$ | $=CH-CH=CH-$ | H |
| d-15 | 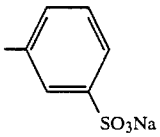 | $-(CH_2)_2SO_3Na$ | $=CH-CH=CH-$ | H |
| d-16 | $-CH_3$ | $-(CH_2)_2SO_3K$ | $=CH-$ | H |
| d-17 | 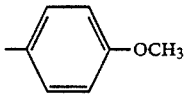 | $-(CH_2)_2SO_3K$ | $=CH-CH=CH-$ | H |
| d-18 | 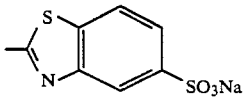 | $-C_2H_5$ | $=CH-CH=CH-$ | H |
| d-19 | $-{}^nC_6H_{13}$ | $-(CH_2)_2SO_3K$ | $=CH-$ | H |
| d-20 | $-(CH_2)_3SO_3Na$ | H | $=CH-$ | H |

These dyes can be prepared by the methods disclosed in, e.g., U.S. Pat. Nos. 3,247,127, 3,469,985, 3,653,905 and 4,078,933.

Specific examples of dyes represented by Formula (I-e) are given below, although the invention is not to be construed as being limited to these examples.

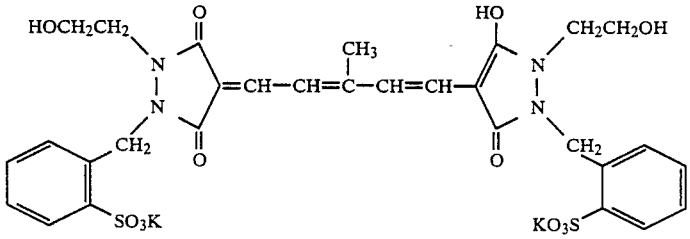

(e-1)

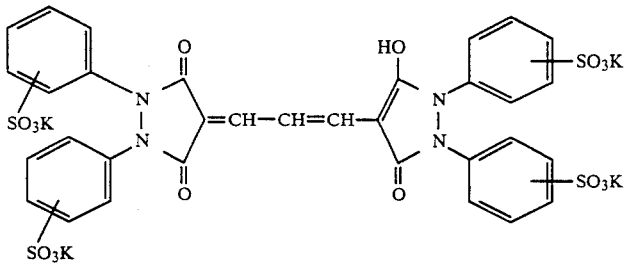

(e-2)

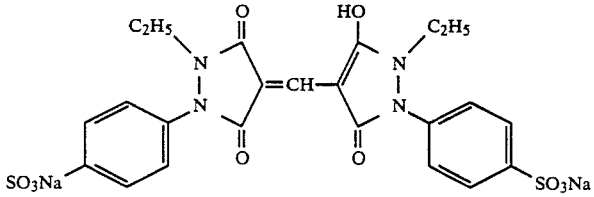

(e-3)

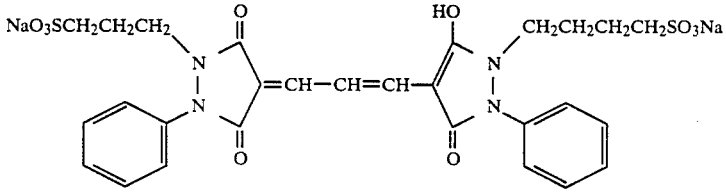

(e-4)

-continued
(e-5)
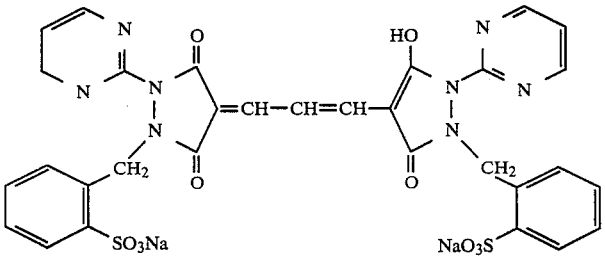
(e-6)
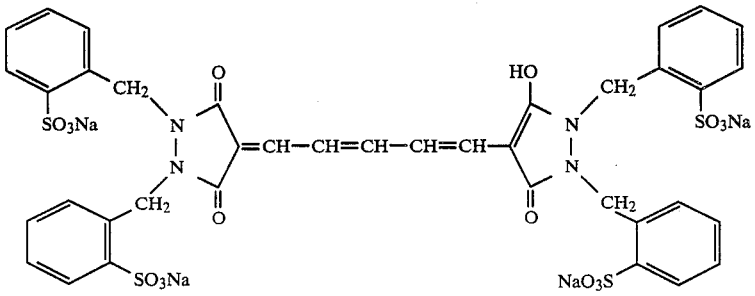
(e-7)
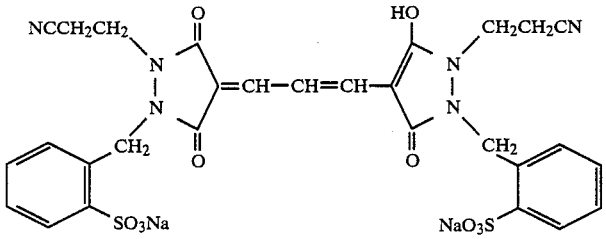
(e-8)
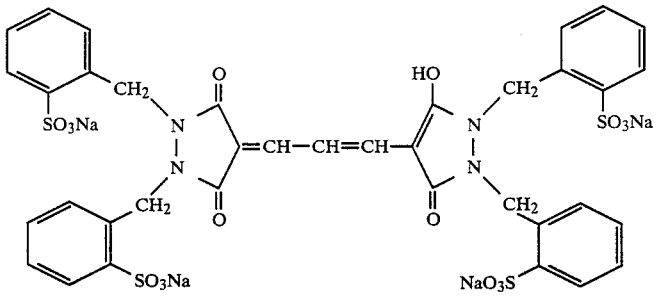
(e-9)
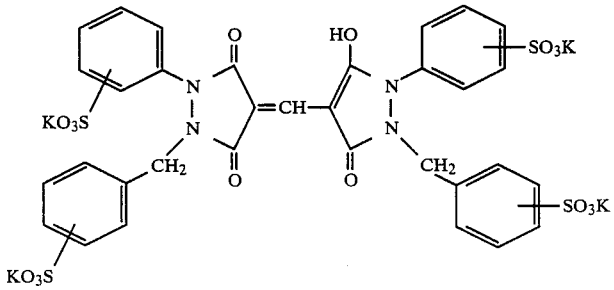

-continued

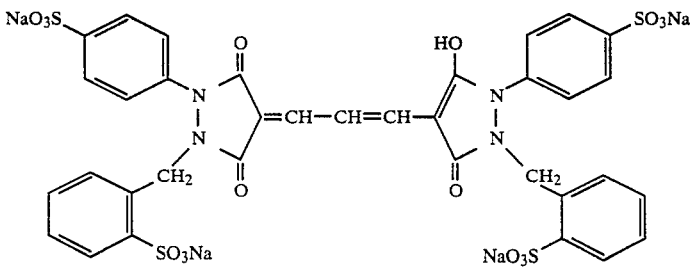

(e-10)

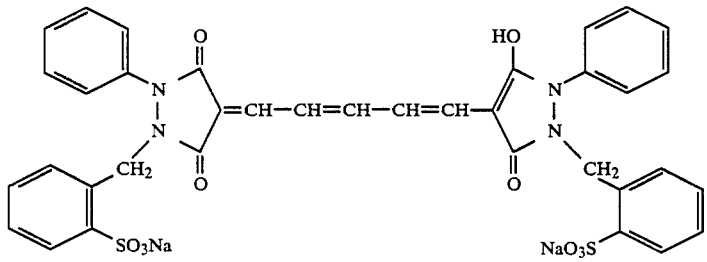

(e-11)

The compounds represented by Formula (I-e) can be prepared by a variety of methods. For example, as shown by the reaction shematics below, they can be prepared by condensing a 1,2-disubstituted-3,5-pyrazolidinedione (A) and a compound as represented by (B-1), (B-2), (B-3), (B-4) or (B-5) in the presence of a base.

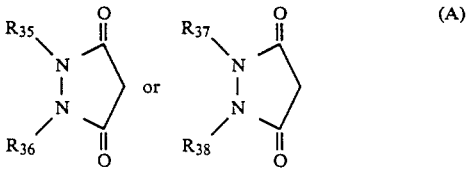

(A)

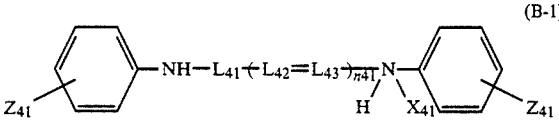

(B-1)

$HC(OC_2H_5)_3$ (B-2)

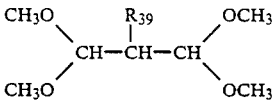

(B-3)

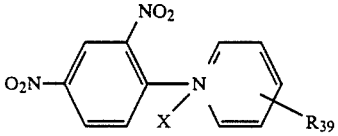

(B-4)

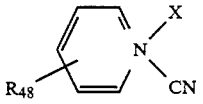

(B-5)

In the formulas, $R_{35}$, $R_{36}$, $R_{37}$, $R_{41}$, $R_{42}$, $R_{43}$ and $n_{41}$ have the same meanings as noted earlier and $Z_{41}$ represents a hydrogen atom, a nitro group or a halogen atom (e.g., chlorine, bromine). $R_{39}$ represents a hydrogen atom, an alkyl group (e.g., methyl, ethyl) or a phenyl group. $X_{41}$ represents an anion (e.g., chloride, bromide, iodide, perchlorate, methyl sulfate, ethyl sulfate, p-toluenesulfonate)

The compounds represented by Formula (A) can easily be prepared by condensing a 1,2-disubstituted-hydrazine and a malonic acid derivative, as described in *Chemical Abstracts*, Vol. 50,8743e (1956).

Specific examples of dyes represented by Formula (II) that can be used in the present invention are given below but the present invention is not to be construed as being limited these examples.

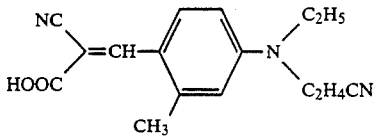

II-1

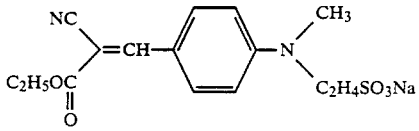

II-2

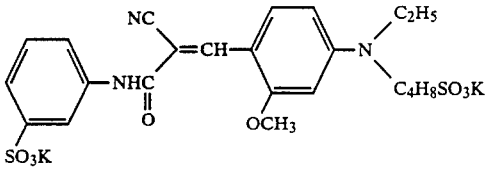

II-3

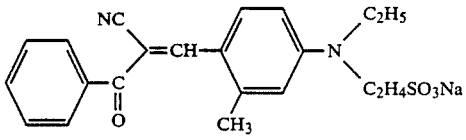

II-4

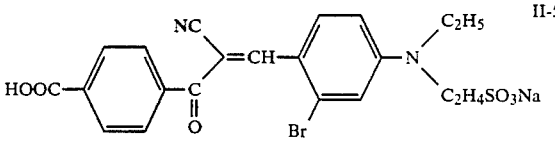

II-5

-continued
II-6
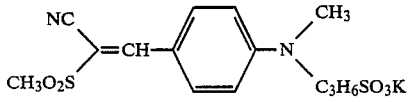
II-7
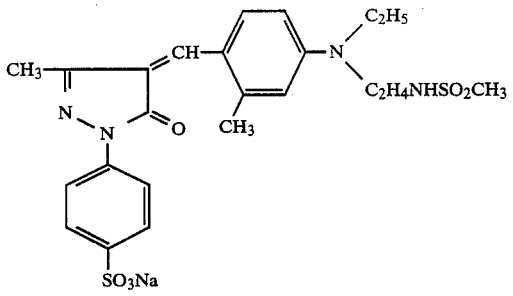
II-8
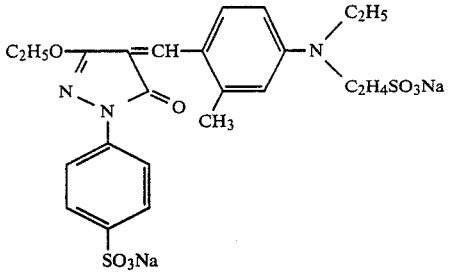
II-9
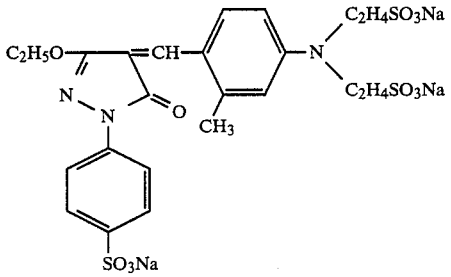
II-10
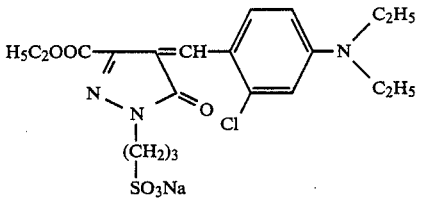
II-11
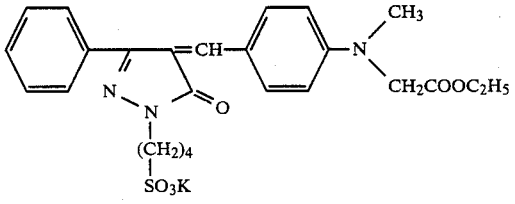
-continued
II-12
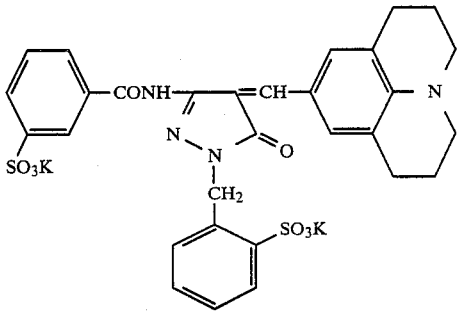
II-13
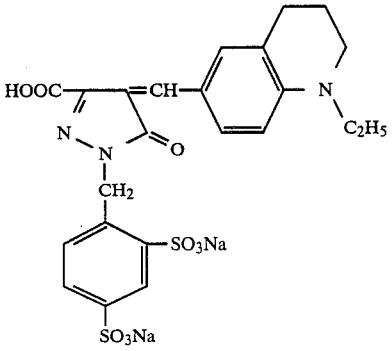
II-14
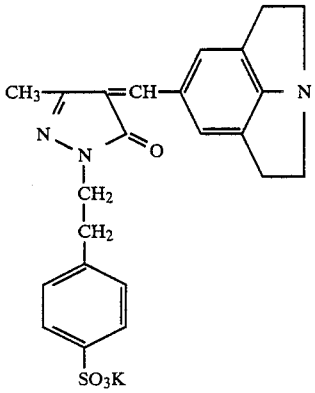
II-15
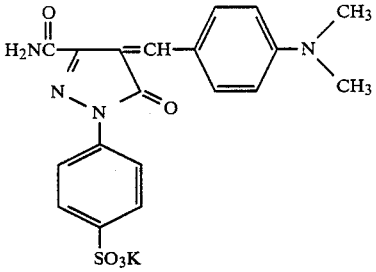
II-16
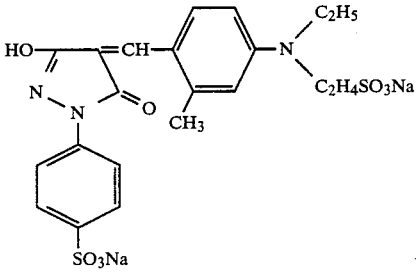

-continued
II-17
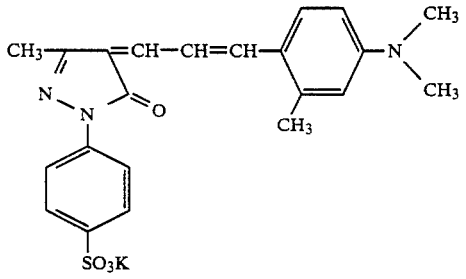
II-18
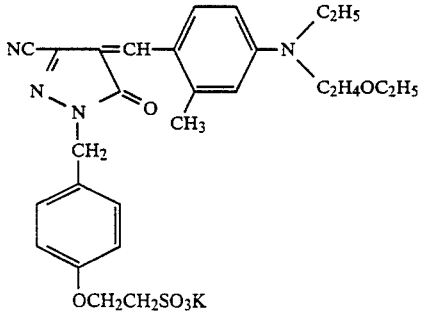
II-19
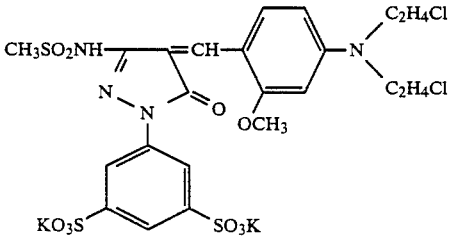
II-20
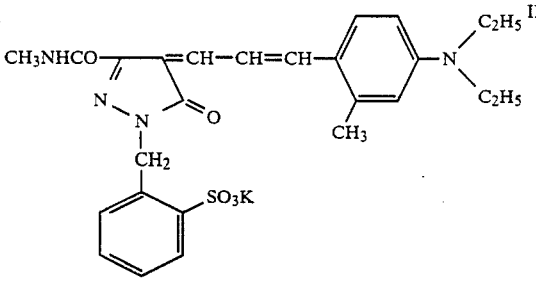
II-21
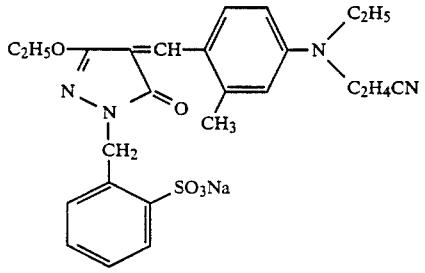
-continued
II-22
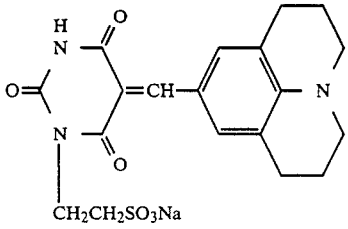
II-23
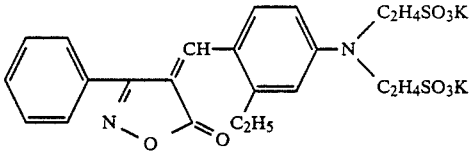
II-24
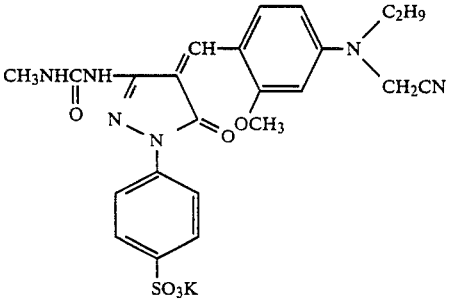
II-25
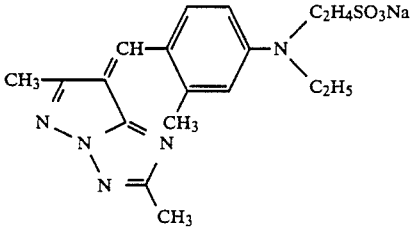
II-26
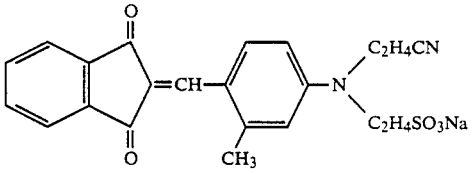
II-27
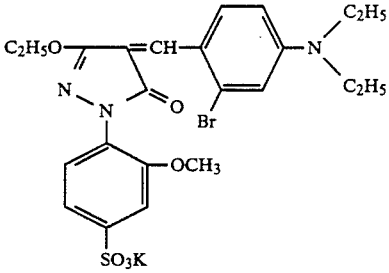
The dyes represented by Formula (II) can be easily prepared by a method such as that disclosed in JP-A-51-3623.
Specific examples of dyes represented by Formula (III) are given below but the invention is not to be construed are being limited to these examples.

III-1
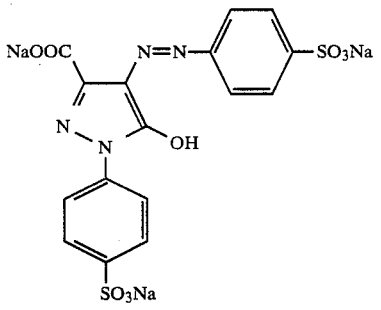
III-2
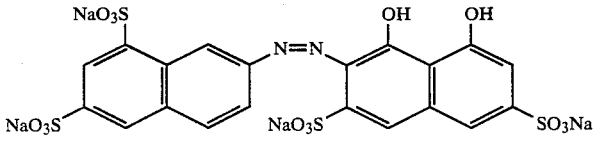
III-3
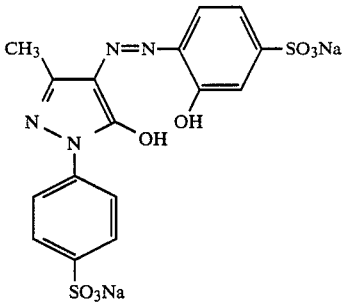
III-4
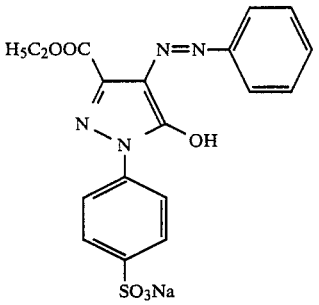
III-5
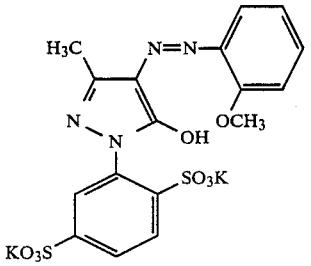

-continued
III-6
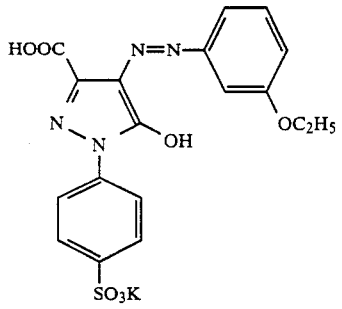
III-7
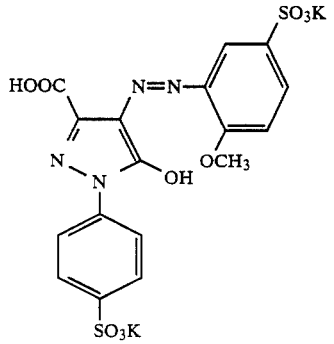
III-8
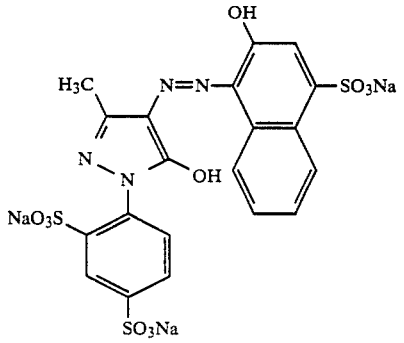
III-9
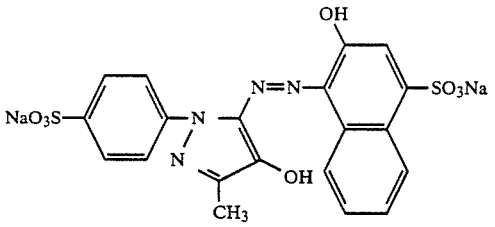
III-10
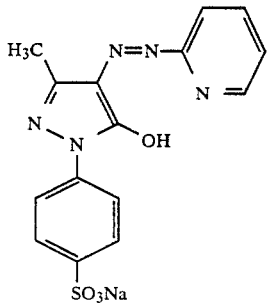

-continued
III-11
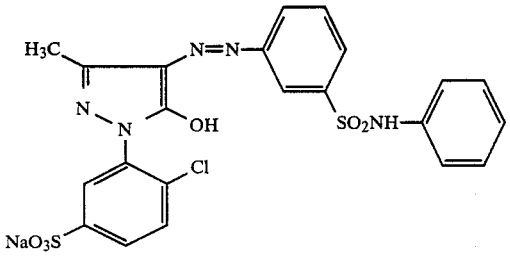
III-12
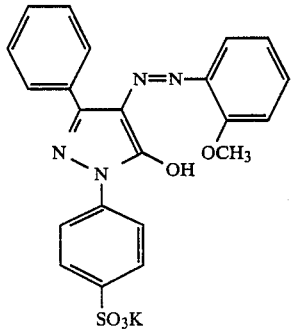
III-13
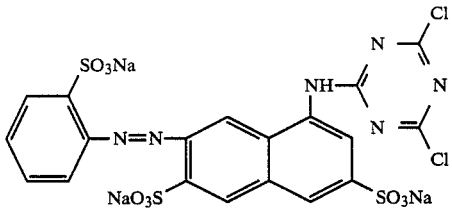
III-14
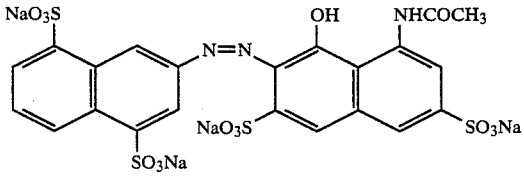
III-15
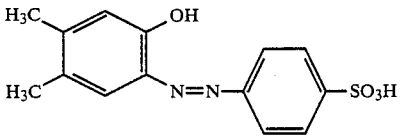
III-16
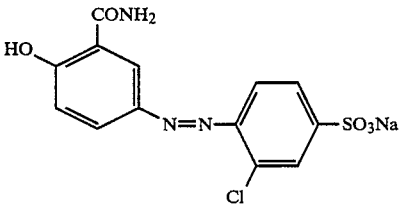
III-17
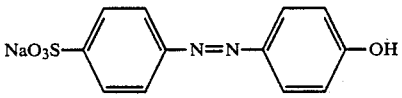
III-18
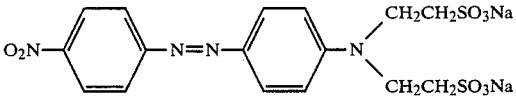

-continued
III-19
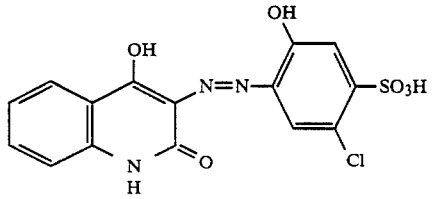
III-20
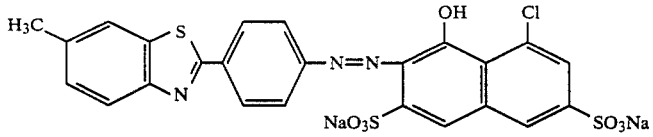
III-21
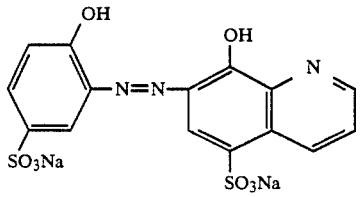
III-22
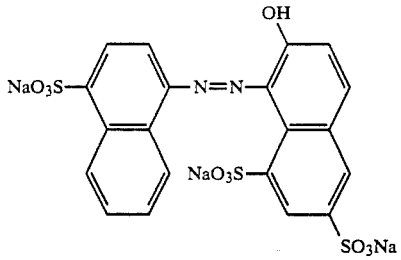
The dyes represented by Formula (III) can be prepared by the methods disclosed in, e.g., GB Pat. Nos. 575,691, 907,125 and 1,353,525.
Specific examples of dyes represented by formula (IV) are given below but the present invention is not to be construed as being limited to these examples.
IV-1
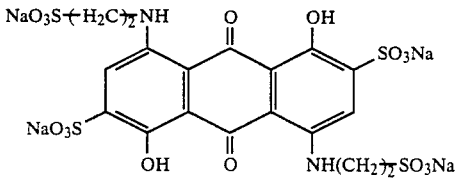
IV-2
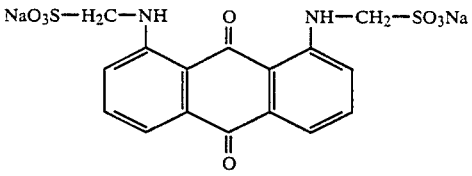
IV-3
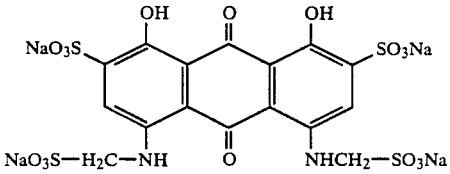
IV-4
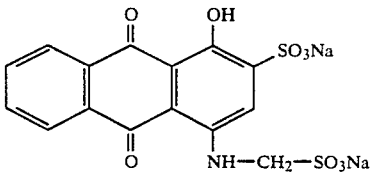

-continued
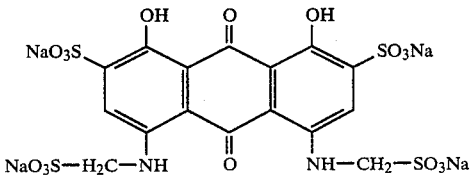
IV-5
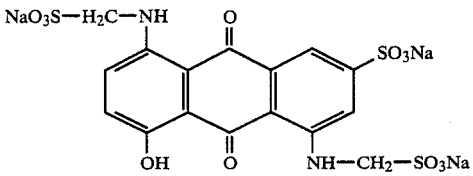
IV-6
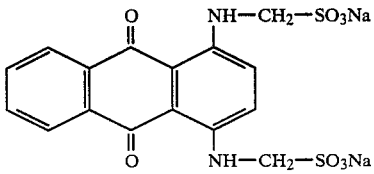
IV-7
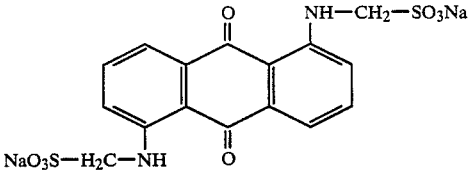
IV-8
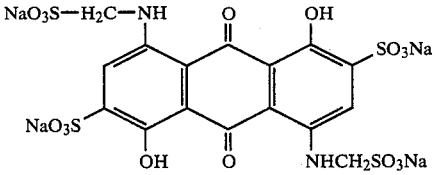
IV-9
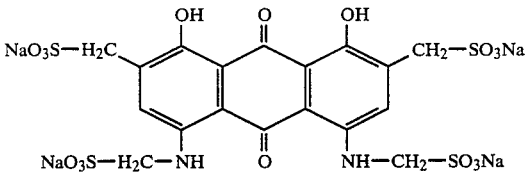
IV-10
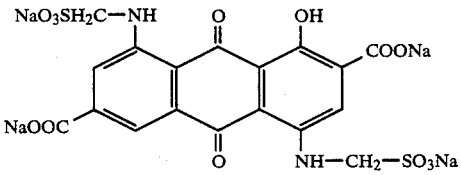
IV-11
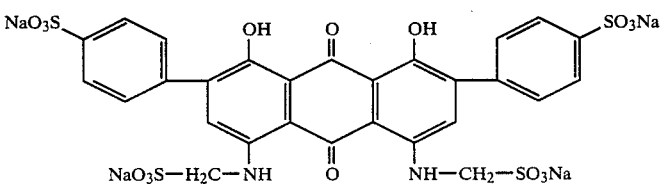
IV-12

-continued
IV-13
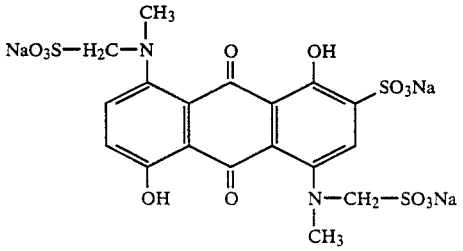
IV-14
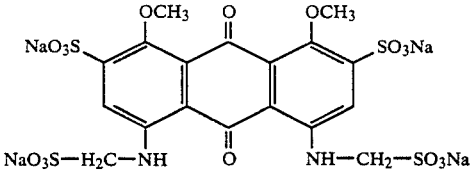
IV-15
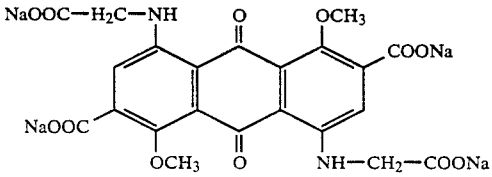
IV-16
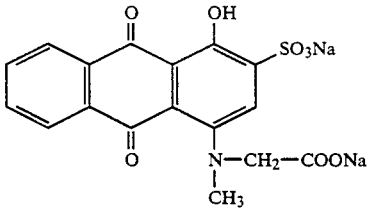
IV-17
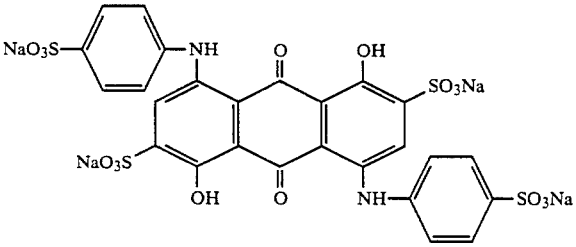
IV-18
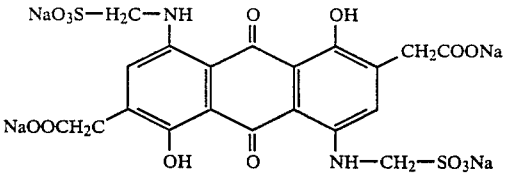
IV-19
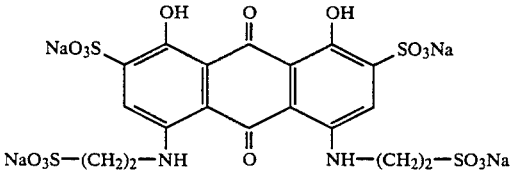
IV-20
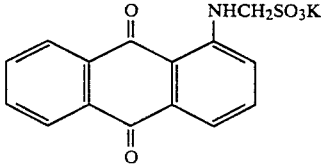

-continued

IV-21

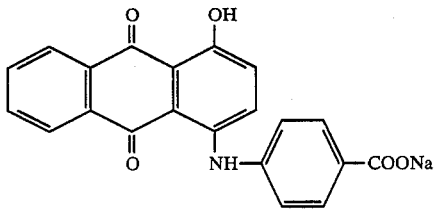

IV-22

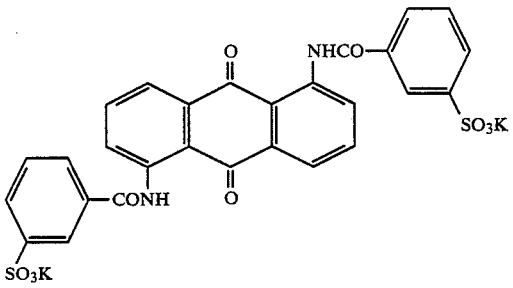

IV-23

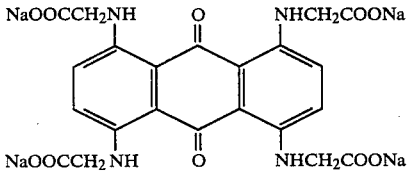

The dyes represented by Formula (IV) can be prepared by the method disclosed in U.S. Pat. No. 2,865,752.

Particularly preferred dyes of the dyes represented by Formulas (I), (II), (III) and (IV) are those of the Formula (I), especially those of Formulae (I-a), (I-b) and (I-c).

In the present invention, the dry film thickness from the photosensitive emulsion layer that is farthest from the support to the photosensitive emulsion layer that is nearest the support can easily be determined by taking a sectional photograph of the sensitive material under the following conditions. A microtome is used to prepare a cut cross-sectional plane of a sample material on which emulsions have been coated and dried and the cut plane is coated with, e.g., gold, palladium or carbon and then photographed with a scanning electron microscope.

The above film thickness is from about 5 to about 16.0 μm, and preferably not more than 15.0 μm. It is impossible to obtain a marked improvement in sharpness if the thickness is greater than 16.0 μm.

The thinner the film the better, and there are no particular restrictions regarding the lower limit of the film thickness. A suitable method of reducing the film thickness is to reduce the amount of gelatin or other binders or to reduce the amount of oil used in coupler emulsification. However, excessive reduction adversely affects the photographic characteristics (especially fogging), pressure characteristics and storability, etc., of emulsions and also the incubation resistance of emulsions, and the reductions should therefore be set within a range such that these various characteristics are not deleteriously affected.

The swelling ratio (x) of the photosensitive material of the invention is defined as follows. When a photosensitive material, whose total film thickness comprising photosensitive silver halide emulsion layers, intermediate layers and protective layers, etc. is "a" μm, is swelled for 5 minutes in distilled water at 25° C. and its total film thickness becomes "b" μm, then x =b/a. In the invention, this swelling ratio is 1.25 or more and is preferably 1.30 or more and still more preferably 1.40 to 2.0. The term "total film thickness" as used herein does not include the thickness of the support and of any hydrophilic layers coated on the support on the opposite side of the photosensitive silver halide emulsion layers, such as a backing layer provided for preventing curling.

A variety of color couplers can be used in the present invention, and specific examples thereof are described in the patents listed in the above-described *Research Disclosure,* No. 17643, VII - C to G. Couplers which give the three primary colors for a subtractive color system (i.e., yellow, magenta and cyan) in color development are important as dye-forming couplers and specific examples of 4-equivalent or 2-equivalent couplers which are hydrophobic and have been made dispersion-resistant are disclosed in the patents noted in *Research Disclosure,* No. 17643, Items VII - C and D, and, in addition to these couplers, the following couplers may suitably be used in the present invention. Typical examples of yellow couplers which can be used in the present invention include hydrophobic acylacetamide couplers possessing ballast groups. Specific examples of these couplers are disclosed in U.S. Pat. Nos. 2,407,210, 2,875,057 and 3,265,506. Use of 2-equivalent yellow colors is preferred in the present invention. Specific examples of such couplers include the oxygen atom elimination type yellow couplers disclosed in, e.g., U.S. Pat. Nos. 3,408,194, 3,447,928, 3,933,501 and 4,022,620 and nitrogen atom elimination type yellow couplers disclosed in, e.g., JP-B-58-10739, U.S. Pat. Nos. 4,401,752 and 4,326,024, *Research Disclosure,* No 18053 (Apr. 1979), GB Pat. No. 1,425,020 and West German Patent Applications (Laid-Open) 2,219,917, 2,261,361, 2,329,587 and 2,433,812. The color dye fastness, especially the light-fastness is excellent with α-pivaloylacetanilide couplers, while α-benzoylacetanilide couplers provide high color density.

Magenta couplers which can be used in the present invention include hydrophobic indazolone or cyanoacetyl couplers possessing ballast groups, preferably 5-pyrazolone and pyrazoloazole couplers. Of the 5-pyrazolone couplers, those couplers with the 3-position substituted by an arylamino or acylamino group are preferred from standpoint of coupler dye hue and coloring density. Typical examples of such couplers are disclosed in, e.g., U.S. Pat. Nos. 2,311,082, 2,343,703, 2,600,788, 2,908,573, 3,062,653, 3,152,896 and 3,936,015. The nitrogen atom elimination groups disclosed in U.S. Pat. No. 4,310,619 and the arylthio groups disclosed in U.S. Pat. No. 4,351,897 are particularly preferred as 2-equivalent 5-pyralozone coupler elimination groups. High color density is also achieved by the 5-pyrazolone couplers possessing ballast groups that are disclosed in European Patent No. 73,636. The pyrazolobenzimidazoles disclosed in U.S. Pat. Nos. 3,061,432 and preferably the pyrazolo[5,1-c][1,2,4]triazoles disclosed in U.S. Pat. No. 3,725,067, the pyrazolotetrazoles disclosed in *Research Disclosure,* No. 24220 (June 1984) and the pyrazolopyrazoles disclosed in *Research Disclosure,* No. 24230 (June 1989) and JP-A-60-43659 can be cited as pyrazoloazole couplers. The imdazo[1,2-b]pyrazoles disclosed in U. S. Pat. No. 4,500,630 are preferred and the pyrazolo[1,5-b][1,2,4]triazoles disclosed in European Patent No. 119,860A are particularly preferred because they have good light fastness and are associated with little coupler dye secondary yellow absorption.

Yellow couplers that can be used in the present invention also include hydrophobic, dispersion-resistant naphtholic and phenolic couplers. Representative examples of these couplers are the naphtholic couplers disclosed in U.S. Pat. No. 2,474,293 and, as preferred couplers, the oxygen atom elimination type 2-equivalent naphtholic couplers disclosed in U.S. Pat. Nos. 4,052,212, 4,146,396, 4,228,233 and 4,296,200. Specific examples of phenolic couplers are given in, e.g., U.S. Pat. Nos. 2,369,929, 2,801,171, 2,772,162 and 2,895,826.

Preferably, cyan couplers that are fast to temperature and humidity are used in the invention. Typical examples of these couplers include the phenolic cyan couplers disclosed in U.S. Pat. No. 3,772,002 which have ethyl or higher alkyl groups in the meta positions of the phenol nucleus, the 2,5-diacylaminosubstituted phenolic couplers disclosed in U.S. Pat. Nos. 2,772,162, 3,758,308, 4,126,396, 4,334,011 and 4,327,173, Laidopen West German Pat. No. 3,329,729 and European Pat. No. 121,365 and the phenolic couplers disclosed in U.S. Pat. Nos. 3,446,622, 4,333,999, 4,451,559 and 4,427,767 which have phenylureido groups in the 2-positions and acylamino groups in the 5-positions.

The cyan couplers disclosed in European Pat. No. 161,628A which have sulfonamido, amido or other groups substituted in 5-positions of the naphthol ring provide excellent color image fastness and these couplers can also be preferably used in the present invention.

It is preferable to effect masking by combined use of colored couplers in a photographic color-sensitive material in order to compensate for unwanted coupler dye absorption. Yellow-colored magenta couplers as disclosed in, e.g., U. S. Pat. No. 4,163,670 and JP-B-57-39413 and magenta-colored cyan couplers as disclosed in, e.g., U.S. Pat. Nos. 4,004,929 and 4,138,258 and GB Pat. No. 1,146,368 can be cited as typical examples. Other colored couplers are disclosed in the above-described *Research Disclosure,* No. 17643, Item VII - G.

Graininess can be improved by the combined use of couplers in which the coupling dyes possess a suitable degree of dispersibility. Specific examples of such couplers are the magenta couplers disclosed in U.S. Pat. No. 4,366,237 and GB Pat. No. 2,125,570 and specific examples of yellow, magenta and cyan couplers are disclosed in West German Patent Application (OLS) No. 3,234,533.

The dye-forming couplers and the above-described special couplers may form dimers or higher polymers Typical examples of polymerized dye-forming couplers are given in U.S. Pat. Nos. 3,451,820 and 4,080,211. Specific examples of polymerized magenta couplers are given in GB Pat. No. 2,102,173 and U.S. Pat. No. 4,367,282.

The molecular weight of polymer couplers employed in the present invention is preferably 10,000 or more, with couplers with a molecular weight of 20,000 to 100,000 being particularly preferred.

Other couplers that may suitably be used in the present invention are couplers that release photographically useful groups as coupling proceeds. The couplers disclosed in the patents cited in *Research Disclosure,* No. 17643, Item VII - F are useful as DIR couplers which release development inhibitors.

Preferred compounds for use in combination with the present invention are development solution deactivation types as typified by the compounds of JP-A-57-151944, timing types as typified by the compounds of U.S. Pat. No. 4,248,962 and JP-A-57-154234 and reactive types as typified by the compounds of Japanese Patent Application No. 59-39653, and particularly preferred compounds include the development solution deactivation type DIR couplers described in JP-A-57-151944, JP-A-53-217932 and Japanese Patent Application Nos. 59-75474, 59-82214 and 59-90438 and the reactive couplers described in Japanese Patent Application No. 59-39653.

Redox type DIR couplers are also suitable for use in the present invention. Preferred DIR hydroquinones for use in combination with the present invention are disclosed in, e.g., U.S. Pat. Nos. 336402 and 337952 and particularly preferred DIR hydroquinones are the compounds disclosed in JP-A-50-62435. JP-A-50-133833, JP-A-50-119631, JP-A-51-51941 and JP-A-52-57828.

The couplers used in the present invention may be introduced into the photosensitive material using a variety of known dispersion methods, and typical examples of which that can be used are solid dispersion and alkali dispersion methods and, as a preferred method, latex dispersion or, as a still more preferred method, oil-in-water droplet dispersion. In the oil-in-water droplet dispersion process, the coupler can be dissolved in either a high boiling point organic solvent having a boiling point of 175° C. or more or a so-called co-solvent having a low boiling point, or a mixture thereof, and the resulting solution can be microdispersed in water, a gelatin aqueous solution or a similar aqueous medium in the presence of a surfactant. Examples of high boiling point solvents are described in, e.g., U.S. Pat. No. 2,322,027. Dispersion may be accompanied by phase inversion and, if required, the product may be coated after removal of or a reduction in the amount of the co-solvent by distillation, noodle washing or ultrafiltration, etc.

Specific examples of the stages and effects of latex dispersion methods and of latexes for impregnation are disclosed in, e.g., U.S. Pat. No. 4,199,363 and West German Patent Applications (OLS) 2,541,274 and 2,541,230.

The preferred order of the layers for the present invention is, from the support, red-sensitive, green-sensitive and blue-sensitive or blue-sensitive, red-sensitive and green-sensitive. Also, each of these emulsion layers may comprise two or more emulsion layers with different sensitives or may comprise a non-photosensitive layer or layers between two or more emulsion layers that have the same sensitivity. Normally, cyan-forming couplers are present in red-sensitive layers, magenta-forming couplers are present in green-sensitive layers and yellow-forming couplers are present in blue-sensitive layers but in some cases other combinations can be used.

Preferably, in addition to the silver halide emulsion layers, the photosensitive material of the present invention also suitably has auxiliary layers such as protective, intermediate, filter, antihalation and backing layers.

Suitable supports for use in the present invention are described in, e.g., *Research Disclosure,* No. 17643, page 28 and ibid., No. 18716, page 647, right-hand column, to page 648, left-hand column.

The color photographic photosensitive material of the invention can be developed by conventional methods such as described in the above-mentioned *Research Disclosure,* No. 17643, pages 28 to 29 and ibid., No. 18716 page 651, left-hand column to right-hand column.

The color development solution used for developing the photosensitive material of the present invention is preferably an alkaline aqueous solution containing a primary aromatic amine developing agent as a principal component. Aminophenol compounds are useful as such color developing agents and p-phenylenediamine compounds are preferred. Typical examples of these that may be employed include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniniline, 3-methyl-4-amino-N-ethyl-N-β-methoxyethylaniline and sulfates, hydrochlorides and p-toluenesulfonates of these substances. Generally, the diamines are more stable and suitable for use when they are in the form of salts than they are when they are in a free state.

Normally in development processing of reversal color photosensitive materials, color development is performed after black and white development. Known black and white developing agents, such as hydroquinone or similar dihydroxybenzenes, 1- phenyl-3-pyrazolidone or similar 3-pyrazolidones and N-methyl-p-aminophenol or similar aminophenols can be used alone or in combination in this black and white development solution.

After color development, the photographic emulsion layers are usually subjected to bleaching, which may be effected simultaneously with or separately from fixing. The processing method may also be one in which bleach-fixing is effected following bleaching in order to speed up processing. Iron (III), cobalt (III), chromium (VI), copper (II) or similar polyvalent metal compounds, peracids, quinones or nitro compounds, for example, are used as bleaching agents. Typical bleaching agents which can be used include ferricyanide; bichromates; iron (III) and cobalt (III) complex organic salts, e.g., complex salts of organic acids such as ethylenediaminetetra-acetic acid, diethylenetriaminepentaacetic acid, nitrilotriacetic acid, 1,3-diamino-2-propanoltetraacetic acid and similar aminopolycarboxylic acids, citric acid, tartaric acid and malic acid; persulfates; manganates; and nitrosophenols. Within these substances, iron (III) ethylenediaminetetra-acetate, iron (III) diethylenetriaminepentaacetate and persulfates are preferable from the points of view of speed of development and environmental pollution. Iron (III) ethylenediaminetetra-acetate is particularly useful, both in independent bleach solutions and in single-bath bleach-fix solutions.

Examples of fixing agents which can be used include thiosulfates, thiocyanates, thioether compounds, thioureas and a large quantities of iodides but generally thiosulfates are employed. Sulfites, bisulfites and carbonyl - bisulfurite adducts are preferred as preservatives for bleach-fix solutions or fixing solutions.

Bleach-fixing or fixing is normally followed by washing and a stabilization treatment. A variety of known compounds may be employed the purpose of economical use of water and preventing precipitation in the washing and stabilization stages. For example, to prevent precipitation, addition as required can be made of inorganic phosphoric acids, aminopolycarboxylic acids, organic aminopolyphosphonic acids, organic phosphoric acids or similar hard water softeners, bactericides and antifungal agents for preventing growth of bacteria and algae or molds, metal salts as typified by salts of magnesium, aluminum and bismuth salts, surfactants for preventing drying loads and unevenness and various types of film hardeners. One may also add compounds such as those described by, e.g., L. E. West, *Photographic Science and Engineering,* Vol. 6. pages 344 to 359 (1965).

With color-sensitive material for photography, a (washing-stabilization) stage following fixing normally performed can be substituted for the above-described stabilization stage and washing stage (water-saving processing). In this case, if the magenta coupler is a 2-equivalent coupler, it is permissible to remove formaldehyde from the stabilization bath.

The washing and stabilization processing time in the present invention varies depending on the type of sensitive material and the processing conditions but is normally 20 seconds to 10 minutes and preferably 20 seconds to 5 minutes. Descriptions of such are given in JP-A-58-50533, JP-A-58-50534, JP-A-58-50535 and JP-A-58-11543.

In the present invention, various processing solutions are used at a temperature of from 10 to 50° C. A temperature of from 33° C. to 38° C. is standard, but processing can be speeded up and the processing time shortened by increasing the temperature. Conversely, improved picture quality and good processing solution stability can be achieved by decreasing the temperature.

The present invention is further discribed in greater detail with reference to the following examples.

EXAMPLE

A multilayer color photosensitive material with layers of the compositions noted below was prepared on a subbed cellulose triacetate film and designated as Sample 101.

| First Layer:Antihalation Layer |
|---|
| Gelatin Layer (dry film thickness 2 μm) |

-continued

| First Layer:Antihalation Layer | |
|---|---|
| containing | |
| Black Colloidal Silver | 0.25 g/m$^2$ |
| Ultraviolet Ray Absorber U-1 | 0.1 g/m$^2$ |
| Ultraviolet Ray Absorber U-2 | 0.1 g/m$^2$ |
| High Boiling Point Organic Solvent Oil-1 | 0.1 cc/m$^2$ |

| Second Layer:Intermediate Layer - 1 | |
|---|---|
| Gelatin Layer (dry film thickness 0.4 μm) containing | |
| Compound E | 10 mg/m$^2$ |
| High Boiling Point Organic Solvent Oil-3 | 40 mg/m$^2$ |

Third Layer : Intermediate Layer - 2

Gelatin Layer (dry film thickness 0.4 μm) containing a surface-fogged microparticle silver iodobromide emulsion
(Silver content: 0.05 g/m$^2$)
(average grain diameter 0.06 μm, AgI content 1 mol%)

Fourth Layer : First Red-Sensitive Emulsion Layer

Gelatin Layer (dry film thickness 2.0 μm) containing a silver iodobromide emulsion spectrally sensitized with Sensitization Dyes S-1 and S-2 (a 4 : 1 by weight mixture of monodisperse cubic grain Emulsion A with average grain diameter of 0.35 μm and AgI content of 5 mol% and monodisperse hexahedral grain Emulsion B with average grain diameter of 0.5 μm and AgI content of 5 mol%) Silver content: 0.4 g/m$^2$)

| | |
|---|---|
| Coupler C-1 | 0.2 g/m$^2$ |
| Coupler C-2 | 0.05 g/m$^2$ |
| High Boiling Point Organic Solvent Oil-1 | 0.1 cc/m$^2$ |

Fifth Layer : Second Red-Sensitive Emulsion Layer

Gelatin Layer (dry film thickness 1.0 μm) containing silver iodobromide emulsion spectrally sensitized by Sensitization Dyes S-1 and S-2 (monodisperse cubic grain emulsion C; average grain diameter 0.5 μm, AgI content 4 mol%) (Silver content: 0.4 g/m$^2$)

| | |
|---|---|
| Coupler C-1 | 0.2 g/m$^2$ |
| Coupler C-3 | 0.2 g/m$^2$ |
| Couler C-2 | 0.05 g/m$^2$ |
| High Boiling Point Organic Solvent Oil-1 | 0.1 cc/m$^2$ |

Sixth Layer : Third Red-Sensitive Emulsion Layer

Gelatin Layer (dry film thickness 1.8 μm) containing silver iodobromide emulsion spectrally sensitized by Sensitization Dyes S-1 and S-2 (multiple twin crystal emulsion D; average grain diameter 0.75 μm, AgI content 2 mol%, average aspect ratio 1.8) (Silver content: 0.4 g/m$^2$)

| | |
|---|---|
| Coupler C-3 | 0.7 g/m$^2$ |

Seventh Layer : Intermediate Layer - 3

Gelatin Layer (dry film thickness 0.7 μm) containing

| | |
|---|---|
| Compound A | 2.00 g/m$^2$ |

Eighth Layer : Intermediate Layer - 4

Gelatin Layer (dry film thickness 1.8 μm) containing surface-fogged micrograin silver iodobromide emulsion average grain diameter 0.06 μm, AgI content 1 mol% (Silver content: 0.05 g/m$^2$)

| | |
|---|---|
| Compound B | 0.2 g/m$^2$ |

Ninth Layer : First Green-Sensitive Emulsion Layer

Gelatin Layer (dry film thickness 1.2 μm) containing silver iodobromide emulsion spectrally sensitized by Sensitization Dyes S-3 and S-4 (5 to 1 mixture of monodisperse cubic grain Emulsion E with average grain diameter of 0.35 μm and AgI content of 5 mol% and monodisperse cubic grain emulsion F with average grain diameter of 0.5 μm and AgI content of 4.0 mol%) (Silver content: 0.5 g/m$^2$)

| | |
|---|---|
| Coupler C-4 | 0.3 g/m$^2$ |
| Compound C | 0.03 g/m$^2$ |

Tenth Layer : Second Green-Sensitive Emulsion Layer

Gelatin Layer (dry film thickness 0.8 μm) containing silver iodobromide emulsion containing Sensitization Dyes S-3 and S-4 (monodisperse cubic grain emulsion G; average grain diameter 0.5 μ, AgI content 5 mol%) (Silver content: 0.4 g/m$^2$)

| | |
|---|---|
| Coupler C-4 | 0.3 g/m$^2$ |
| Compound C | 0.03 g/m$^2$ |

Eleventh Layer : Third Green-Sensitive Emulsion Layer

Gelatin Layer (dry film thickness 2.0 μm) containing silver iodobromide emulsion containing Sensitization Dyes S-3 and S-4 (multiple twin crystal emulsion H; average grain diameter 0.75 μm, AgI content 2 mol%, average aspect ratio 1.7) (Silver content: 0.5 g/m$^2$)

| | |
|---|---|
| Coupler C-4 | 0.8 g/m$^2$ |
| Compound C | 0.08 g/m$^2$ |

Twelfth Layer : Intermediate Layer - 5

Gelatin Layer (dry film thickness 0.4 μm) containing

| | |
|---|---|
| Compound A | 3.00 g/m$^2$ |

Thirteenth Layer : Yellow Filter Layer

Gelatin Layer (dry film thickness 0.3 μm) containing

| | |
|---|---|
| Yellow Colloidal Silver | 0.1 g/m$^2$ |
| Compound B | 0.01 g/m$^2$ |

Fourteenth Layer : Intermediate Layer - 6

Gelatin Layer (dry film thickness 0.2 μm)

Fifteenth Layer : First Blue-Sensitive Emulsion Layer

Gelatin Layer (dry film thickness 1.5 μm) containing silver iodobromide emulsion spectrally sensitized by Sensitization Dyes S-5 and S-6 (5 to 1 mixture of monodisperse cubic grain Emulsion I with average grain diameter of 0.35 μm and AgI content of 4 mol% and monodisperse cubic grain Emulsion J with average grain diameter of 0.50 μm and AgI content of 4 mol%) (Silver content: 0.6 g/m$^2$)

| | |
|---|---|
| Coupler C-5 | 0.6 g/m$^2$ |

Sixteenth Layer : Second Blue-Sensitive Emulsion Layer

Gelatin Layer (dry film thickness 1.0 μm) containing silver iodobromide emulsion spectrally sensitized by Sensitization Dyes S-7 and S-8 (monodisperse cubic grain Emulsion K; average grain diameter 0.55 μm, AgI content 3 mol%) (Silver content: 0.4 g/m$^2$)

| | |
|---|---|
| Coupler C-5 | 0.3 g/m$^2$ |
| Coupler C-6 | 0.3 g/m$^2$ |

Seventeenth Layer : Third Blue-Sensitive Layer

Gelatin Layer (dry film thickness 2.8 μm) containing silver iodobromide emulsion spectrally sensitized by Sensitization Dyes S-7 and S-8 (multiple twin crystal Emulsion L; average grain diameter 0.80 μm, AgI content 1.3 mol%, average aspect ratio 1.8) (Silver content: 0.4 g/m$^2$)

| | |
|---|---|
| Coupler C-6 | 0.7 g/m$^2$ |

Eighteenth Layer : First Protective Layer

Gelatin Layer (dry film thickness 3.0 μm) containing

| | |
|---|---|
| Ultraviolet Ray Absorber U-1 | 0.04 g/m$^2$ |
| Ultraviolet Ray Absorber U-3 | 0.03 g/m$^2$ |
| Ultraviolet Ray Absorber U-4 | 0.03 g/m$^2$ |
| Ultraviolet Ray Absorber U-5 | 0.05 g/m$^2$ |
| Ultraviolet Ray Absorber U-6 | 0.05 g/m$^2$ |
| Compound D | 0.8 g/m$^2$ |
| Dye D-1 | 0.05 g/m$^2$ |

Nineteenth Layer : Second Protective Layer

Gelatin Layer (dry film thickness 0.5 μm) containing micrograin silver iodobromide emulsion (average grain diameter 0.06 μm, AgI content 1 mol%) (Silver content: 0.1 g/m$^2$)

| | |
|---|---|
| Yellow Colloidal Silver | 2 mg/m$^2$ |

Twentieth Layer : Third Protective Layer

Gelatin Layer (dry film thickness 1.4 μm) containing Polymethyl methacrylate grains

| | |
|---|---|
| (average grain diameter 1.5 μm) | 0.1 g/m$^2$ |

4 : 6 molar ratio copolymer of methyl methacrylate and acrylic acid (average grain diameter 1.5 μm) 0.1 g/m$^2$Silicone Oil 0.03 g/m$^2$

| | |
|---|---|
| Fluorine-Containing Surfactant W-1 | 3 mg/m$^2$ |

In addition to the compositions noted above, Surfactant W-1 was added to each layer. The compounds used in the above samples were as follows.

C-1

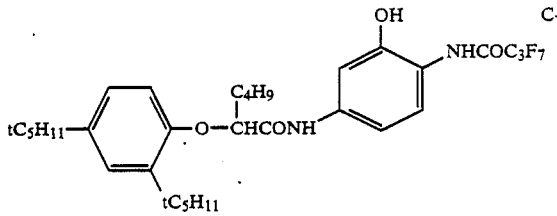

C-2

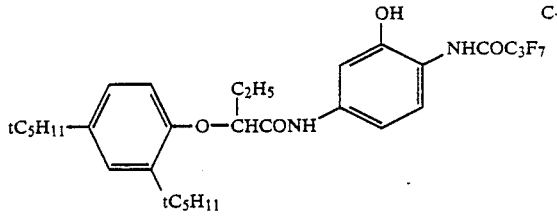

C-3

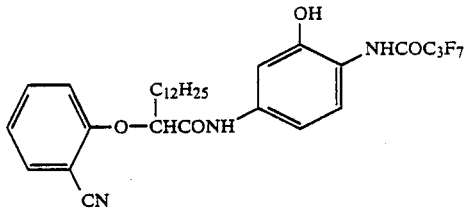

C-4

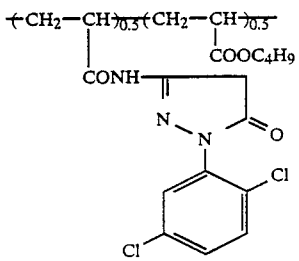

-continued
C-5
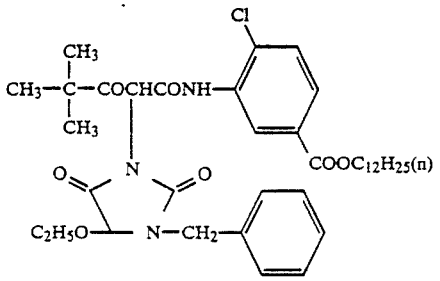
C-6
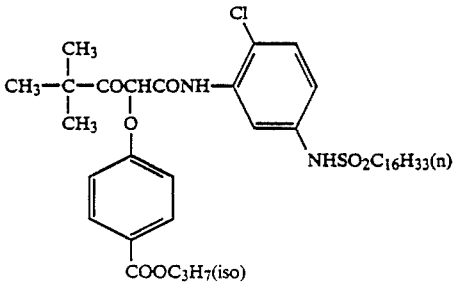
S-1
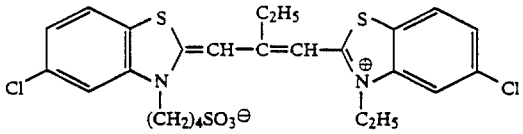
S-2
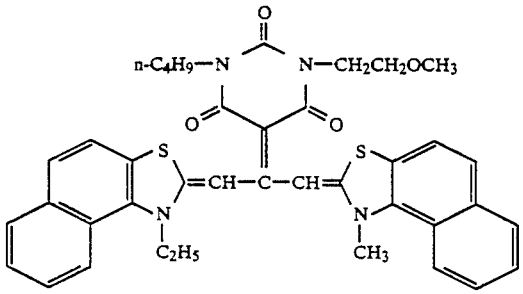
S-3
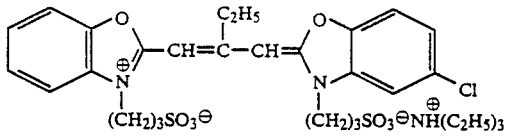
S-4
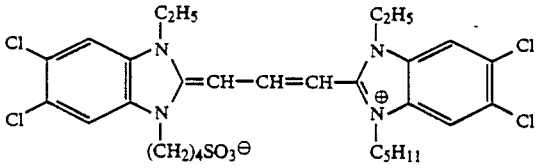
S-5
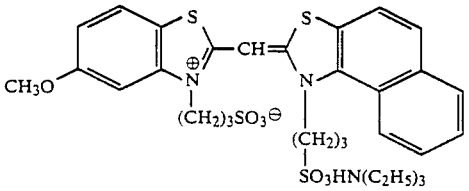
-continued
S-6
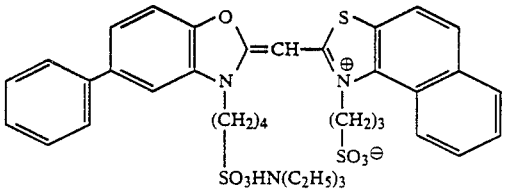
U-1
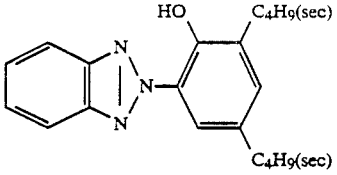
U-2
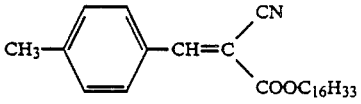
U-3
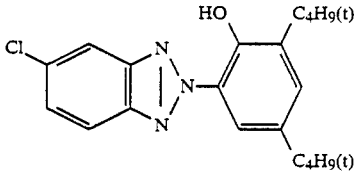
U-4
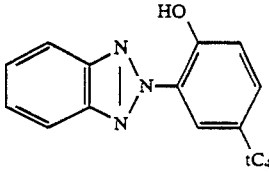
U-5
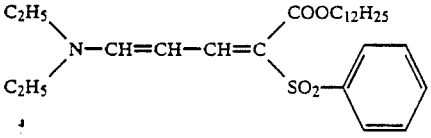
U-6
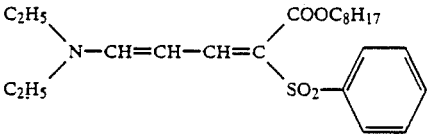
Oil 1 Dibutyl phthalate
Oil 2 Tricresyl phosphate
Oil 3
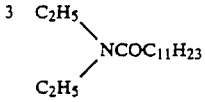
Compound A
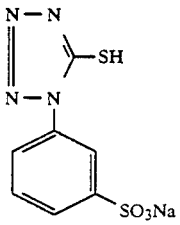

-continued

Compound B

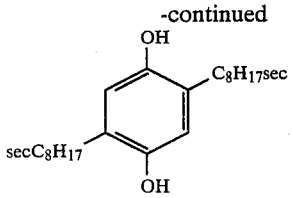

Compound C

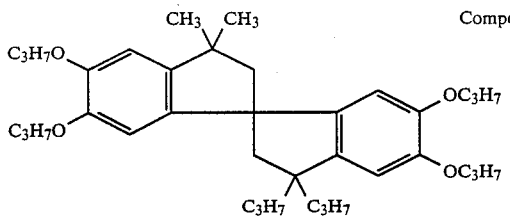

Compound D

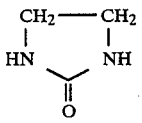

Compound E

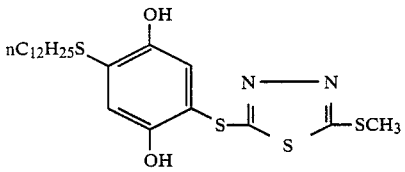

D-1

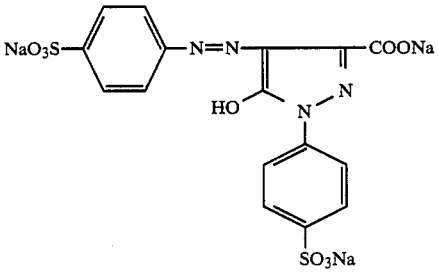

H-1

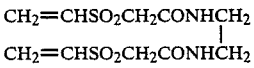

W-1

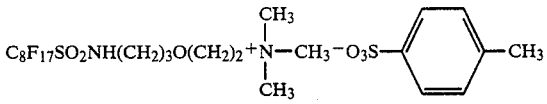

Known procedures were used to prepare the tabular emulsions noted below for Sample 101 which were designated Emulsions 1 to 12. These emulsions had the same degrees of sensitivity as the various emulsions A to L when the following substitutions were made in their respective layers.

| Emulsion | Layer in which Used | Aspect Ratio | AgI Content (mol %) |
|---|---|---|---|
| 1 | 4th layer | 3.5 | 5.0 |
| 2 | " | 5.5 | 5.0 |
| 3 | 5th layer | 5.0 | 4.0 |
| 4 | 6th layer | 8.0 | 2.0 |
| 5 | 9th layer | 3.0 | 5.0 |
| 6 | " | 5.0 | 4.0 |
| 7 | 10th layer | 5.5 | 5.0 |
| 8 | 11th layer | 9.0 | 2.0 |
| 9 | 15th layer | 5.0 | 4.0 |
| 10 | " | 6.0 | 4.0 |
| 11 | 16th layer | 7.0 | 3.0 |
| 12 | 17th layer | 12.0 | 1.3 |

Substitution of the tabular Emulsions 1 to 12 for Emulsions A to L gave the following Types I to V.

| Type | Substitution Layer (name of emulsion) |
|---|---|
| I | No substitution |
| II | 11(H → 8), 16(K → 11), 17(L → 12) |
| III | 6(D → 4), 10(G → 7), 11(H → 8), 16(K → 11), 17(L → 12) |
| IV | 5(C → 3), 6(D → 4), 10(G → 7), 11(H → 8), 15(I, J → 9, 10), 16(K → 11), 17(L → 12) |
| V | 1 ~ 12 (A, B . . . L → 1, 2 . . . 12) |

The dry film thickness (designated as "d" below) from the Fourth Layer to the Seventeenth Layer in Sample 101 was 17 μm. d=15 μm samples were prepared using a constant ratio reduction of the gelatin coating quantity in the Fourth, Fifth, Sixth, Ninth, Tenth, Eleventh, Fifteenth, Sixteenth and Seventeenth Layers. d=13 μm samples were similary prepared by a still further reduction in the coated gelatin quantity.

The amounts added of I-a-11 as the dye for reducing the sensitivity of the red-sensitive layer and of I-a-12 as the dye for reducing the sensitivity of the green-sensitive layer were varied in accordance with the required degree in sensitivity reduction.

The swelling ratio was varied by altering the amount of Hardener H-1 added to the Seventeenth Layer and the Eighth Layer.

In this manner, Samples 101 to 130 were prepared with the different tabular emulsion substitution types (S), dry film thicknesses (d) from the Fourth Layer to the Seventeenth Layer, ratios (D) in reduction in sensitivity of green-sensitive layer or red-sensitive layer using dyes and swelling ratios (x) as noted in Table 1.

Samples 101 to 130 were each exposed via a white wedge and then subjected to development processing as shown below and the sharpness of the red-sensitive layers and the green-sensitive layers was investigated.

| Processing Stages | | |
|---|---|---|
| Stage | Time | Temperature |
| First Development | 6 minutes | 38° C. |
| Washing | 2 minutes | " |
| Reversal | 2 minutes | " |
| Color Development | 6 minutes | " |
| Conditioning | 2 minutes | " |
| Bleaching | 6 minutes | " |
| Fixing | 4 minutes | " |
| Washing | 4 minutes | " |
| Stabilization | 1 minutes | Normal temperature |
| Drying | | |

The following processing solution compositions were used.

| First Development Solution | |
|---|---|
| Water | 700 ml |
| Nitrilo-N,N,N-trimethylenephosphonic Acid Pentasodium Salt | 2 g |
| Sodium Sulfite | 20 g |
| Hydroquinone Monosulfonate | 30 g |
| Sodium Carbonate (monohydrate) | 30 g |

-continued

| | |
|---|---|
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% aq. solution) | 2 ml |
| Water added | 1000 ml |
| Reversal Solution | |
| Water | 700 ml |
| Nitrilo-N,N,N-trimethylenephosphonic Acid Pentasodium Salt | 3 g |
| Stannous Chloride (dihydrate) | 1 g |
| p-Aminophenol | 0.1 g |
| Sodium Hydroxide | 8 g |
| Glacial Acetic Acid | 15 ml |
| Water added | 1000 ml |
| Color Development Solution | |
| Water | 700 ml |
| Nitrilo-N,N,N-trimethylenephosphonic Acid Pentasodium Salt | 3 g |
| Sodium Sulfite | 7 g |
| Sodium Triphosphate (dodecahydrate) | 36 g |
| Potassium Bromide | 1 g |
| Potassium Iodide (0.1% aq. solution) | 90 ml |
| Sodium Hydroxide | 3 g |
| Citrazinic Acid | 1.5 g |
| N-Ethyl-N-(-methanesulfonamidoethyl)-3-methyl-4-aminoaniline Sulfate | 11 g |
| 3,6-Dithiaoctane-1,8-diol | 1 g |
| Water added | 1000 ml |
| Conditioning Solution | |
| Water | 700 ml |
| Sodium Sulfite | 12 g |

-continued

| | |
|---|---|
| Sodium Ethylenediaminetetra-acetate (dihydrate) | 8 g |
| Thioglycerin | 0.4 ml |
| Glacial Acetic Acid | 3 ml |
| Water added | 1000 ml |
| Bleaching Solution | |
| Water | 800 ml |
| Sodium Ethylenediaminetetra-acetate (dihydrate) | 2 g |
| Ferri(III)ammonium Ethylenediamine-tetraacetate (dihydrate) | 120 g |
| Potassium Bromide | 100 g |
| Water added | 1000 ml |
| Fixing Solution | |
| Water | 800 ml |
| Ammonium Thiosulfate | 80.0 g |
| Sodium Sulfite | 5.0 g |
| Sodium Bisulfite | 5.0 g |
| Water added | 1000 ml |
| Stabilization Solution | |
| Water | 800 ml |
| Formaldehyde (37 aq. wt %) | 5.0 ml |
| Fuji Drywell (surfactant manufactured by Fuji Film KK) | 5.0 ml |
| Water added | 1000 ml |

Color reversal sensitivity comparisons were made on the basis of the amounts of exposure needed to achieve a density 0.2 greater than the minimum density. Sharpness measurements were expressed as MTF values. The results obtained are summarized in Table 1 below.

TABLE 1

| Sample No. | Emulsion Substi-tution Type | Dry Film Thick-ness | Reduction in Sensi-tivity by Dye | Swelling Ratio X | MIF (lines/mm) Green Sensitive Layer 10 Lines | Green Sensitive Layer 30 Lines | Red Sensitive Layer 10 Lines | Red Sensitive Layer 30 Lines | Remarks |
|---|---|---|---|---|---|---|---|---|---|
| 101 | I | 16.5 | 0 | 1.20 | 1.02 | 0.56 | 0.96 | 0.36 | Comparison example |
| 102 | II | " | " | " | 1.01 | 0.64 | 0.96 | 0.43 | " |
| 103 | III | " | " | " | 1.00 | 0.66 | 0.94 | 0.47 | " |
| 104 | IV | " | " | " | 1.00 | 0.68 | 0.93 | 0.50 | " |
| 105 | V | " | " | " | 0.99 | 0.68 | 0.93 | 0.51 | " |
| 106 | I | " | " | " | 1.04 | 0.59 | 1.00 | 0.38 | " |
| 107 | " | 13 | " | " | 1.05 | 0.60 | 1.01 | 0.39 | " |
| 108 | " | 17 | −11(RL only) | " | 1.02 | 0.56 | 0.98 | 0.40 | " |
| 109 | " | 17 | −24(RL only) | " | " | 1.01 | 0.42 | " | " |
| 110 | " | " | −37(RL only) | " | " | " | 1.02 | 0.43 | " |
| 111 | " | " | −11(GL only) | " | 1.03 | 0.58 | 0.96 | 0.36 | " |
| 112 | " | " | −24(GL only) | " | 1.05 | 0.61 | " | " | " |
| 113 | " | " | −37(GL only) | " | 1.06 | 0.63 | " | " | " |
| 114 | " | " | −37(RL,GL) | " | 1.06 | 0.63 | 1.02 | 0.43 | " |
| 115 | " | " | 0 | 1.35 | 1.06 | 0.59 | 1.00 | 0.38 | " |
| 116 | " | " | " | 1.50 | 1.08 | 0.61 | 1.03 | 0.39 | " |
| 117 | I | 13 | −37(RL,GL) | 1.50 | 1.12 | 0.67 | 1.05 | 0.46 | " |
| 118 | II | " | " | " | 1.17 | 0.83 | 1.11 | 0.62 | The invention |
| 119 | III | " | " | " | 1.19 | 0.85 | 1.12 | 0.64 | " |
| 120 | IV | " | " | " | 1.20 | 0.87 | 1.14 | 0.67 | " |
| 121 | V | " | " | " | 1.21 | 0.88 | 1.15 | 0.69 | " |
| 122 | " | 15 | " | " | 1.17 | 0.86 | 1.10 | 0.64 | " |
| 123 | " | 17 | " | " | 1.06 | 0.77 | 1.00 | 0.52 | Comparison example |
| 124 | " | 13 | 0 | " | 1.06 | 0.73 | 1.02 | 0.52 | " |
| 125 | " | " | −11(RL only) | " | " | " | 1.06 | 0.57 | " |
| 126 | " | " | −24(RL only) | " | " | " | 1.12 | 0.65 | The invention |
| 127 | " | " | −37(RL only) | " | " | " | 1.15 | 0.69 | " |
| 128 | " | " | −11(GL only) | " | 1.10 | 0.77 | 1.02 | 0.52 | Comparison example |
| 129 | " | " | −24(only) | " | 1.18 | 0.86 | " | " | The invention |
| 130 | " | " | −37(only) | " | 1.21 | 0.88 | " | " | " |
| 131 | " | " | −37(RL),−24(GL) | " | 1.18 | 0.86 | 1.15 | 0.69 | " |
| 132 | " | " | " | 1.35 | 1.15 | 0.83 | 1.12 | 0.62 | " |
| 133 | V | 13 | −37(RL,GL) | 1.20 | 1.05 | 0.74 | 1.01 | 0.54 | Comparison example |
| 134 | III | 13 | −24(GL) | 1.50 | 1.18 | 0.84 | 0.99 | 0.48 | The invention |
| 135 | IV | 13 | −37(RL) | 1.50 | 1.06 | 0.66 | 1.14 | 0.68 | " |
| 136 | V | 15 | −24(RL,GL) | 1.35 | 1.16 | 0.81 | 1.11 | 0.64 | " |
| 137 | V | 15 | " | 1.50 | 1.17 | 0.83 | 1.12 | 0.66 | " |
| 138 | III | 13 | " | 1.35 | 1.16 | 0.80 | 1.09 | 0.60 | " |
| 139 | II | 13 | −37(RL,GL) | " | 1.15 | 0.80 | 1.08 | 0.61 | " |

TABLE 1-continued

| Sample No. | Emulsion Substitution Type | Dry Film Thickness | Reduction in Sensitivity by Dye | Swelling Ratio X | MIF (lines/mm) Green Sensitive Layer 10 Lines | Green Sensitive Layer 30 Lines | Red Sensitive Layer 10 Lines | Red Sensitive Layer 30 Lines | Remarks |
|---|---|---|---|---|---|---|---|---|---|
| 140 | III | 13 | " | " | 1.18 | 0.84 | 1.11 | 0.63 | " |

As is clear from the results in Table 1, the values achieved for the MTF values of the green-sensitive layers and red-sensitive layers of the samples of the invention are values which are not achievable using any one of the individual factors of emulsion substitution type, dry film thickness, reduction in sensitiviety by dye and swelling ratio individually. Further, if any one of these four factors is outside the range of the present invention, there is a marked reduction in GL or RL MTF values and the synergistic effects of the four factors are clearly apparent in the samples of the invention.

According to the present invention, silver halide photographic photosensitive materials with markedly improved sharpness are provided as descrubed above. This marked improvement in sharpness is the result of the synergistic effects due to the combination of the factors noted above and is something that was completely unforeseeable on consideration of these factors individually.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one red-sensitive silver halide emulsion layer, at least one green-sensitive silver halide emulsion layer and at least one blue-sensitive silver halide emulsion layer, wherein each of the green-sensitive silver halide emulsion layer, the red-sensitive silver halide emulsion layer and the blue-sensitive silver halide emulsion layer contains at least one color image forming coupler, and wherein 50% or more of the total projected area of the silver halide grains in at least one of the emulsion layers comprises tabular silver halide grains having a thickness of less than 0.5 μm, a diameter of 0.6 μm or more and an average aspect ratio of 3 or more, and the red-sensitive emulsion layer and/or the green-sensitive emulsion layer contains a dye in an amount sufficient to reduce the sensitivity thereof by 20% or more based on the sensitivity of the red-sensitive emulsion layer and/or the green-sensitive emulsion layer containing no dye, the dry film thickness from the photosensitive emulsion layer that is farthest from the support to the photosensitive emulsion layer that is nearest the support is 16.0 μm or less and the swelling ratio of the silver halide color photographic material, excluding the support and any hydrophilic layers coated on the support on the opposite side of the photosensitive silver halide emulsion layers, is 1.25 or more.

2. The silver halide color photographic material of claim 1, wherein the tabular silver halide grains have an aspect ratio of 3 to 50.

3. The silver halide color photographic material of claim 1, wherein the tabular silver halide grains have an aspect ratio of 3 to 8.

4. The silver halide color photographic material of claim 1, wherein the diameter of the tabular silver halide grains is 0.6 to 10 μm.

5. The silver halide color photographic material of claim 1, wherein the diameter of the tabular silver halide grains is 0.6 to 5.0 μm.

6. The silver halide color photographic material of claim 1, wherein the thickness of the tabular silver halide grains is 0.05 to 0.5 μm.

7. The silver halide color photographic material of claim 1, wherein the red-sensitive emulsion layer and/or the green-sensitive emulsion layer contains said dye in an amount sufficient to reduce the sensitivity thereof by 30% or more.

8. The silver halide color photographic material of claim 1, wherein the film thickness is not more than 15 μm.

9. The silver halide color photographic material of claim 1, wherein the swelling ratio of the photosensitive material is 1.25 to 1.60.

10. The silver halide color photographic material of claim 1, wherein said dye is a dye selected from the group consisting of dyes represented by the formulas (I), (II), (III) or (IV):

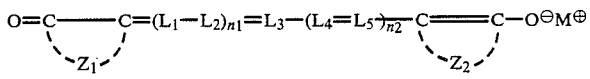

(I)

wherein $Z_1$ and $Z_2$, which may be the same or different, each represents the nonmetallic atoms necessary for forming a heterocyclic ring, $L_1$, $L_2$, $L_3$, $L_4$ and $L_5$, which may be the same or different, each represents a methine group, $n_1$ and $n_2$ each represents 0 or 1 and $M\oplus$ represents hydrogen or another univalent cation.

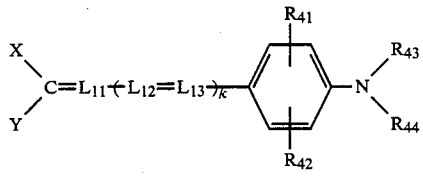

(II)

wherein X and Y, which may be the same or different, each represents an electron-attracting group, and X and Y may combine together to form a ring; $R_{41}$ and $R_{42}$, which may be the same or different, each represents a hydrogen atom, a halogen atom, an alkyl group, an alkoxy group, a hydroxyl group, a carboxyl group, a substituted amino group, a carbamoyl group, a sulfonyl group, an alkoxycarbonyl group or a sulfo group, $R_{43}$ and $R_{44}$, which may be the same or different, each represents a hydrogen atom, an alkyl group, an alkenyl group, an aryl group, an acyl group or a sulfonyl group, or $R_{43}$ and $R_{44}$ may combine together to form a 5- to 6-membered ring, and a combination of $R_{41}$ with $R_{43}$ or of $R_{42}$ with $R_{44}$ may form a 5- or 6-membered heterocyclic ring, at least one of X, Y, $R_{41}$, $R_{42}$, $R_{43}$ and $R_{44}$ having a sulfo or carboxyl group as a substituent;

$$AR_1—N=N—Ar_2 \quad \text{(III)}$$

wherein $Ar_1$ and $Ar_2$, which may be the same or different, each represents an aryl group, or a 5- or 6-membered nitrogen-containing heterocyclic group;

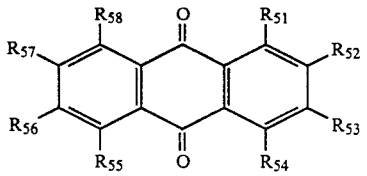

(IV)

wherein $R_{51}$, $R_{54}$, $R_{55}$ and $R_{58}$, which may be the same or different, each represents a hydrogen atom, a hydroxy group, an alkoxy group, an aryloxy group, a carbamoyl group or an amino group

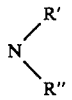

wherein R' and R'', which may be the same or different, each represents an alkyl group or an aryl group possessing at least one sulfonic acid or carboxyl group, or a hydrogen atom); and $R_{52}$, $R_{53}$, $R_{56}$ and $R_{57}$, which may be the same or different, each represents a hydrogen atom, a sulfonic acid group, a carboxyl group, or an alkyl or aryl group possessing at least one sulfonic acid or carboxyl group.

* * * * *